US007802384B2

(12) United States Patent
Kobayashi et al.

(10) Patent No.: US 7,802,384 B2
(45) Date of Patent: Sep. 28, 2010

(54) METHOD AND DEVICE FOR EXCAVATING SUBMERGED STRATUM

(75) Inventors: Toshio Kobayashi, Tokyo (JP); Kazuyoshi Takayama, Sendai (JP); Ken-ichi Ueda, Chofu (JP); Kazuhisa Otomo, Tokyo (JP); Shigehito Uetake, Tokyo (JP)

(73) Assignees: Japan Drilling Co., Ltd., Tokyo (JP); Tohoku University, Miyagi (JP); National University Corporation the University of Electro-Communications, Tokyo (JP)

( * ) Notice: Subject to any disclaimer, the term of this patent is extended or adjusted under 35 U.S.C. 154(b) by 830 days.

(21) Appl. No.: 11/659,730

(22) PCT Filed: Mar. 16, 2006

(86) PCT No.: PCT/JP2006/305234

§ 371 (c)(1),
(2), (4) Date: Feb. 8, 2007

(87) PCT Pub. No.: WO2006/117935

PCT Pub. Date: Nov. 9, 2006

(65) Prior Publication Data

US 2009/0126235 A1 May 21, 2009

(30) Foreign Application Priority Data

Apr. 27, 2005 (JP) ..... 2005-129338

(51) Int. Cl.

| | |
|---|---|
| ***E02F 3/90*** | (2006.01) |
| ***E02F 1/00*** | (2006.01) |
| ***E21C 37/16*** | (2006.01) |
| ***A61N 5/00*** | (2006.01) |

(52) U.S. Cl. ..... 37/335; 37/466; 37/195; 37/323; 250/254; 250/492.1; 299/14; 175/16

(58) Field of Classification Search ..... 37/323, 37/335, 195, 466; 299/14; 175/16, 40, 41; 250/492.1, 254, 493.1

See application file for complete search history.

(56) References Cited

U.S. PATENT DOCUMENTS 3,493,060 A * 2/1970 Van Dyk ..... 175/16

(Continued)

FOREIGN PATENT DOCUMENTS

JP 05118185 A * 5/1993

(Continued)

OTHER PUBLICATIONS

A. Vogel et al., "Energy Balance of Optical Breakdown in Water", SPIE vol. 3254, Jan. 1998, pp. 168-179.

(Continued)

*Primary Examiner*—Thomas A Beach
(74) *Attorney, Agent, or Firm*—Oliff & Berridge, PLC

(57) ABSTRACT

An excavation technique for a stratum capable of excavating a submerged stratum such as a layer containing an underground resource by using laser irradiation in liquid is provided. In this technique, a laser beam transmitted through laser transmission means 20 is irradiated in liquid 90 in form of a laser beam having a wavelength with high absorptance of the liquid 90 by laser-induced bubble generation means 35, generating a bubble flow 36, thus excavation of a submerged stratum may be carried out by using a laser-induced destruction effect. Moreover, a laser beam 41 having low absorptance of the liquid 90 is irradiated by laser irradiation means 39 and passed through the bubble flow 36, thereby applying a thermal effect to a stratum to destroy rock and excavate the stratum. The destruction effect and the thermal effect also may be cooperatively worked.

12 Claims, 25 Drawing Sheets

U.S. PATENT DOCUMENTS

| | | | | | |
|---|---|---|---|---|---|
| 3,539,221 | A | * | 11/1970 | Gladstone et al. | 299/14 |
| 3,693,718 | A | * | 9/1972 | Stout | 166/302 |
| 3,715,596 | A | * | 2/1973 | DeMent | 250/253 |
| 3,871,485 | A | * | 3/1975 | Keenan, Jr. | 175/16 |
| 3,882,945 | A | * | 5/1975 | Keenan, Jr. | 175/16 |
| 3,977,478 | A | * | 8/1976 | Shuck | 175/16 |
| 3,998,281 | A | * | 12/1976 | Salisbury et al. | 175/16 |
| 4,019,331 | A | * | 4/1977 | Rom et al. | 405/234 |
| 4,066,138 | A | * | 1/1978 | Salisbury et al. | 175/16 |
| 4,090,572 | A | * | 5/1978 | Welch | 175/16 |
| 4,227,582 | A | * | 10/1980 | Price | 175/16 |
| 4,412,967 | A | * | 11/1983 | Winterberg | 376/106 |
| 5,356,081 | A | * | 10/1994 | Sellar | 241/1 |
| 6,755,262 | B2 | * | 6/2004 | Parker | 175/57 |
| 6,870,128 | B2 | * | 3/2005 | Kobayashi et al. | 219/121.7 |
| 6,880,646 | B2 | * | 4/2005 | Batarseh | 175/15 |
| 7,147,064 | B2 | * | 12/2006 | Batarseh et al. | 175/11 |
| 7,416,258 | B2 | * | 8/2008 | Reed et al. | 299/14 |
| 7,487,834 | B2 | * | 2/2009 | Reed et al. | 166/297 |
| 7,490,664 | B2 | * | 2/2009 | Skinner et al. | 166/57 |
| 2008/0245568 | A1 | * | 10/2008 | Jeffryes | 175/16 |

FOREIGN PATENT DOCUMENTS

| | | | |
|---|---|---|---|
| JP | 05133180 | A * | 5/1993 |
| JP | A 5-141169 | | 6/1993 |
| JP | A 2002-276276 | | 9/2002 |
| JP | A 2003-184469 | | 7/2003 |
| JP | A 2003-239668 | | 8/2003 |

OTHER PUBLICATIONS

A. Vogel et al., "Shock Wave Energy and Acoustic Energy Dissipation after Laser-Induced Breakdown", SPIE vol. 3254, Jan. 1998, pp. 18-189.

A. Sa'ar et al., "Transmission of Pulsed Laser Beams through "Opaque" Liquids by a Cavitation Effect", Appl. Phys. Lett. vol. 50, No. 22, Jun. 1987, pp. 1556-1558.

A. Tsunenori, "Evaporation Mechanism of Soft Biological Tissue by Infrared Laser Irradiation," T. IEE, Japan, vol. 114-C, No. 5, 1994, pp. 522-528.

* cited by examiner

METHOD AND DEVICE FOR EXCAVATING SUBMERGED STRATUM

TECHNICAL FIELD

The present invention relates to a method and device for excavating a submerged stratum, which is basically a technique used for development of a submerged underground resource, for example. More generally, the present invention is a technique applicable to the fields of civil engineering and architecture, which relates to a technique of excavating a submerged stratum using laser irradiation in liquid.

BACKGROUND ART

Conventionally, an excavation technique of a stratum such as the one used for boring a stratum employs, regardless of in liquid or air, turning force, impactive force, water jet or the like.

A technique employing the turning force uses an excavation bit in a ground boring machine (for example, see Patent Document 1). In this technique, the excavation bit is provided on the front edge of a rotational driveshaft and the ground is excavated by rotation and forward movement of the excavation bit. A power source for the ground excavation is rotational torque. In an excavation technique for development of petroleum and natural gas, the technique employing this rotational torque has become the mainstream.

A boring technique employing the impactive force uses, for example, a percussion drill driven on the bottom of a pit (for example, see Patent Document 2). In this technique, a drilling bit provided on the front edge of a drill string excavates by applying impact blow, or rotation and impact blow to the bit. A power source for the ground excavation is mainly impactive power, in addition to rotational torque.

A ground excavation technique employing water jet includes a shaft excavation process and a device thereof (for example, see Patent Document 3). This technique is such that a shaft is excavated by a high-pressure jet flow emitted by using water jet from a vertical nozzle provided on the end surface of a casing. A source for water jet is a high-pressure pump.

Recently, in development of underground resources in liquid, a laser has been considered for use in ground excavation. This technique is a useful approach when the liquid is highly transparent and allows a laser beam to pass through the liquid sufficiently. In laser irradiation on the ground in transparent liquid, it is possible that in an early stage, the laser beam can reach the ground to fuse and evaporate the ground. However, as fusion and evaporation of the ground progresses, the liquid begins to roil and absorb the laser beam before it reaches the ground, causing a problem that the laser beam may not reach the targeted ground. Therefore, it is considered to be difficult to bore the ground in the opaque liquid by using the laser beam.

It is known that when a laser beam is irradiated in liquid, a bubble is produced and a shock wave is generated (for example, see Non-Patent Documents 1 and 2).

It is also known that there is a close relation between a laser wavelength range and absorptance of liquid (for example, see Non-Patent Documents 3).

It is further known that when a laser beam is passed through opaque liquid, a pulsed laser beam, which has poor transmittance in liquid under ordinary circumstances, can be efficiently transmitted by using a cavitation effect (for example, see Non-Patent Document 4).

It is moreover known that irradiation of an infrared laser beam evaporates soft biological tissue to create a space and the laser beam may be transmitted efficiently through the space (for example, see Non-Patent Document 5).

Patent Document 1: Japanese Patent Laid-Open No. 2002-276276, pp., 2-4, FIG. 1

Patent Document 2: Japanese Patent Laid-Open No. 2003-184469, pp., 2-4, FIG. 2

Patent Document 3: Japanese Patent Laid-Open No. 2003-239668, pp., 2-5, FIG. 1

Non-Patent Document 1: Alfred Vogel et al., "Energy balance of optical breakdown in water", SPIE Vol., 3254, issued on January, 1998, pp., 168-179, (an article about energy balance when a laser beam is irradiated in liquid)

Non-Patent Document 2: Alfred Vogel et al., "Shock wave energy and acoustic energy dissipation after laser-induced breakdown," SPIE Vol., 3254, issued on January, 1998, pp., 180-189, (an article about shock wave energy and acoustic energy dissipation after laser-induced breakdown)

Non-Patent Document 3: "Wavelength range-transmission loss dependent on water content," Latest application technology of fiber optics, issued on August, 2001, pp., 30-31, FIG. 22, (the Figure illustrates relation between a laser wavelength range and absorption of water)

Non-Patent Document 4: A. Saar, D. Gal, "Transmission of pulsed laser beams through opaque liquids by a cavitation effect," American institute of Physics, P1556, issued in 1987, (it describes pulsed laser beam transmission through opaque liquids by a cavitation effect)

Non-Patent Document 5: Tsunenori Arai, "Evaporation mechanism of soft biological tissue by infrared laser irradiation," T. IEE, Japan, Vol. 114-C, No. 5, 1994

An object of the present invention is to provide a novel technique for excavation using a laser beam of a submerged stratum such as a layer containing an underground resource.

DISCLOSURE OF THE INVENTION

When liquid is highly transparent, a laser beam may transmit in the liquid to some extent depending on its wavelength. However, when turbidity in the liquid becomes large due to the excavated stratum during stratum excavation, there occurs a problem that the laser beam may not transmit through the liquid.

In a laser beam generated by a laser oscillator and transmitted through a fiber, incident energy to the fiber decays as a transmission distance is longer, and then there may be a problem that it becomes impossible to irradiate energy sufficient for stratum excavation.

The present invention is made to address the problems described above and provides a method for excavating a submerged stratum that includes the following technical means. That is, in the present invention, excavation of a submerged stratum is carried out by a first laser-induced force generated by laser irradiation in liquid and/or a thermal effect produced by a second laser passing through a bubble created by laser irradiation in liquid.

In the present invention, the term "laser-induced force" means mechanical destructive force generated based on a laser-induced phenomenon when a laser beam is irradiated in liquid.

The first laser-induced force may be developed by an effect such as a shock wave, jet stream, bubble flow, acoustic wave or any combination of more than one of these effects.

The first laser may be a pulsed laser or continuous-wave laser irradiated off and on intermittently. The pulsed laser or continuous-wave laser irradiated off and on intermittently can produce efficiently a laser-induced shock wave, jet stream, bubble flow or acoustic wave in liquid.

At the same time, the second laser may be also a pulsed laser, continuous-wave laser, or a combination of them.

Also, one or both of the first and second lasers may preferably be a solid laser, respectively. The solid laser includes a fiber laser, rod or disk laser, YAG laser, slab laser and semiconductor laser etc. Since these lasers oscillate by applying power, it is easy to control them remotely. Further, because it is possible to miniaturize a solid laser oscillator and dispose it within a pipe etc., installation within a shaft may be allowed.

In bubble creation by a pulsed laser, incident energy concentrates to break down (destroy) liquid and a bubble is grown up rapidly due to high-temperature and pressure plasma and vapor of the liquid, generating a shock wave. A laser-induced shock wave, laser-induced jet stream, laser-induced bubble flow or laser-induced acoustic wave is generated by using a pulsed laser and a submerged stratum is destroyed by using its effect.

Further, high-strength laser beam emission creates a bubble near the end of its output section. A laser beam made to pass through this bubble can irradiate a stratum, excavating the submerged stratum by the laser beam. In a pulsed laser, a pulse is generated faster than disappearance of bubble, thereby developing an effect of a laser-induced shock wave.

Then, a device of the present invention capable of suitably implementing the method of the present invention is a device for excavating a submerged stratum comprising:

(a) first laser oscillation means which outputs a pulsed laser beam and/or continuous-wave laser beam, in which one or more parameters selected from the group consisting of laser pulse energy, laser beam quality, a laser pulse width, a laser frequency and a laser wavelength are adjustable, and/or (b) second laser oscillation means which outputs a pulsed laser beam and/or continuous-wave laser beam, in which a laser frequency and laser wavelength are adjustable, and (c) laser transmission means, and (d) laser irradiation means.

The device of the present invention includes one or both of the first laser oscillation means and the second laser oscillation means. Preferably, both of them are provided to work cooperatively their effects, because a synergistic effect may be obtained. The first laser oscillation means and the second laser oscillation means hereinafter may be called collectively "laser oscillation means."

The laser oscillation means is means for providing various effects when a laser beam is irradiated, for example, means in which a shape and size etc. of a laser irradiation section may be changed so that a laser-induced shock wave, jet, bubble flow or acoustic wave etc. is generated most efficiently, or means in which a laser beam difficult to be absorbed by liquid is irradiated appropriately on a timely manner while maintaining its directional movement.

It is suitable that the device for excavating a submerged stratum further includes laser wavelength conversion means and/or laser pulse compression means. The laser wavelength conversion means may convert a laser wavelength, forming a laser beam having a laser wavelength easy or difficult to be absorbed by liquid. The laser pulse compression means is means which compresses a pulsed laser to form a laser having a high peak ratio, generating large laser-induced force.

Also, when the laser oscillation means is disposed in a pipe within an open hole and a power cable is extended, thereby causing laser oscillation, then a length of the laser transmission means can be shorter, thereby preventing laser decay.

Further, when a laser bit composed of the laser oscillation means and the laser irradiation means is disposed in the front edge of a pipe in an open hole, excavation of a stratum can be most efficiently carried out. When the laser bit further includes the laser wavelength conversion means and/or the laser pulse compression means, a compact device for excavating a submerged stratum including the laser bit capable of accepting any conditions may be provided.

Also, the laser transmission means may be fibers composed of a single fiber and plural fibers and including laser incident means at the midpoint or fibers composed of plural single-fibers, or means including a multicore fiber or bundle fiber. Reduction in energy transferred by one fiber by using plural fibers may mitigate a load to a single fiber and by increasing the number of fibers, a large amount of laser energy needed to excavate rock can be transferred.

According to the present invention, excavation of a submerged stratum may be carried out by using the first laser-induced force. Also, not only when liquid has a high degree of transparency, but when opaque, excavation of a submerged stratum may be carried out by using the thermal effect of the second laser passing through a bubble. Further, cooperation of these effects may improve efficiency of excavation of a submerged stratum.

According to the device for excavating a submerged stratum of the present invention, the method of the present invention may be suitably implemented. Further, by applying use of plural fiber bundles, provision of the laser wavelength conversion means, laser pulse compression means and laser oscillation means within a pipe and the like for the device of the present invention, it becomes possible to irradiate a sufficient laser beam needed for excavation of a submerged stratum.

BRIEF DESCRIPTION OF THE DRAWINGS

FIG. 1 (*b*) is a schematic diagram illustrating the process for generating the shock wave by laser irradiation in liquid.

FIG. 1 (*c*) is a schematic diagram illustrating the process for generating the shock wave by laser irradiation in liquid.

FIG. 1 (*d*) is a schematic diagram illustrating the process for generating the shock wave by laser irradiation in liquid.

FIG. 2 (*b*) is a schematic diagram illustrating the process for generating the jet by laser irradiation in liquid.

FIG. 2 (*c*) is a schematic diagram illustrating the process for generating the jet by laser irradiation in liquid.

BEST MODE FOR CARRYING OUT THE INVENTION

Figure 1A:
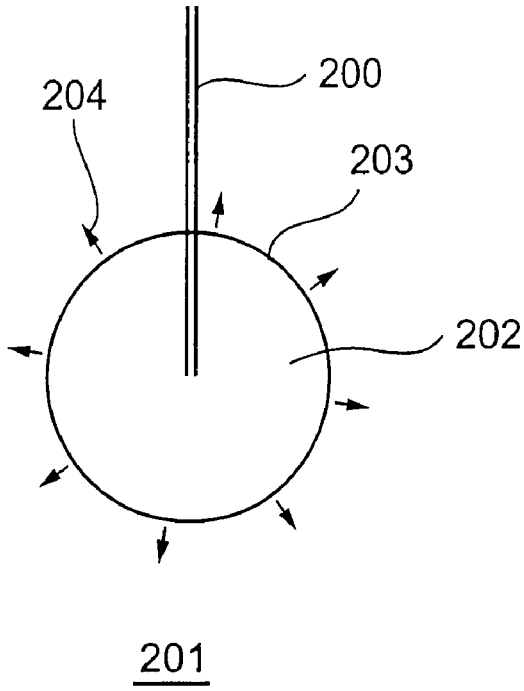
FIG. 1 (*a*) is a schematic diagram illustrating a process for generating a shock wave by laser irradiation in liquid.
Figure 1B:
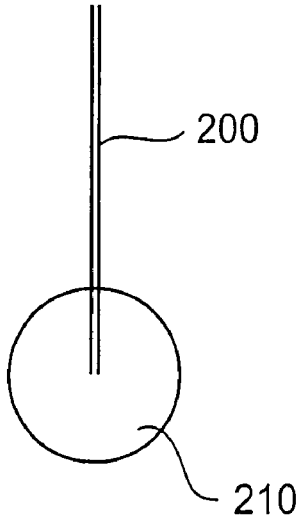
Figure 1C:
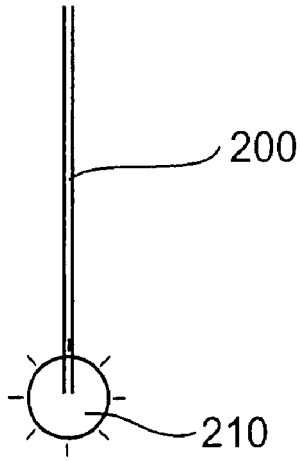
Figure 1D:
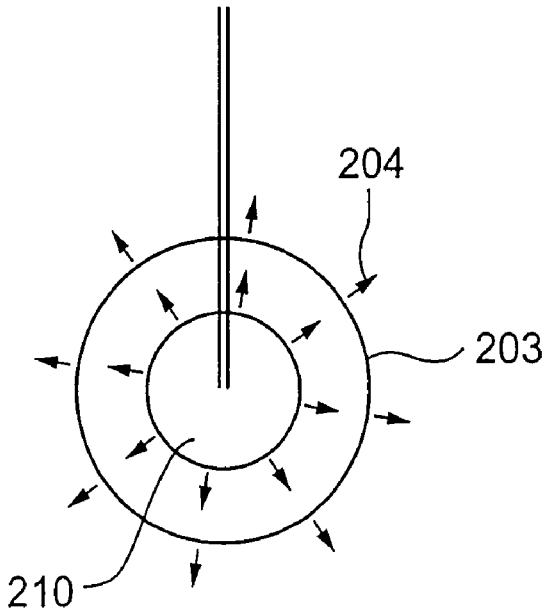

First, parameters representative of laser strength will be described.

A laser output (average output) P is an energy per sec. In a laser turned on and off intermittently, the laser output P is expressed as follows:

$$P=E\times\nu \quad (1)$$

Where, P is the laser output (W), E is a pulse energy (J), and ν is a repetition frequency. Increase in the laser output P may be achieved by increasing either the pulse energy E or the repetition frequency ν.

Next, a fluence F is a value indicating the pulse energy divided by an area.

$$F=E/S \quad (2)$$

Where, F is the fluence (J/cm$^2$), E is the pulse energy (J) and S is the area (cm$^2$).

Next, a laser strength I is a value indicating the fluence F divided by a pulse width.

$$I=E/(St) \quad (3)$$

Where, I is the laser strength (W/cm$^2$) and t is the pulse width (sec).

A spot diameter of laser irradiation is determined by a diameter of a fiber core when a fiber is used. When a lens is used, a desired focused diameter $\omega_0$ is obtained from the following approximate expression:

$$\omega_0=M^2\pi f/(D_0\lambda) \quad (4)$$

Where, $D_0$ is a radius of laser beam on the lens, f is a focused distance of the lens, λ is a laser wavelength and $M^2$ is a characteristic value used for evaluating beam quality.

The first laser causes Photomechanical interaction, Photoacoustic effect, Photoablation, Plasma-induced ablation and Photodisruption etc.

In the second laser of the present invention, when an interaction time between the laser and rock is shorter than a thermal relaxation time, the interaction may be confined within an absorption region of light, thereby inducing a mechanical effect involving adiabatic expansion. On the contrary, when the interaction time between the laser and rock is longer than the thermal relaxation time, heat is widely diffused due to heat conduction, resulting in a predominant thermal effect. The thermal effect includes Photochemical interaction and Photothermal interaction.

A processing speed of rock by a laser and whether rock is destroyed or fused are determined by the laser strength I (W/cm$^2$), the fluence F (J/cm$^2$) and laser absorption characteristics of rock dependent on the laser wavelength. Therefore, breakdown conditions suitable for various targeted rocks may be selected by combining the laser strength I (W/cm$^2$), the fluence F(J/cm$^2$), the laser wavelength and the interaction time between the laser and rock.

Next, functions of how to adjust the laser strength I (W/cm$^2$), the fluence F (J/cm$^2$) and the laser wavelength by using the laser oscillation means, the laser wavelength conversion means and the laser irradiation means will be explained.

Parameters in which the processing speed of rock by a laser acts upon breakdown performance include: (a) the pulse energy, (b) the laser beam quality $M^2$, (c) the laser pulse width, (d) the repetition frequency (Hz), (e) the laser wavelength, (f) the beam diameter on lens, (g) the focused distance of lens, (h) the focused diameter co and (i) the diameter of fiber core.

Parameters adjustable by the laser oscillation means out of these parameters are: (a) the pulse energy, (b) the laser beam quality $M^2$, (c) the laser pulse width, (d) the repetition frequency (Hz) and (e) the laser wavelength.

An adjustable parameter by the laser wavelength conversion means is (e) the laser wavelength.

Adjustable parameters by the laser irradiation means are (f) the beam diameter on lens, (g) the focused distance of lens and (h) the focused diameter $\omega_0$ when a lens is used for irradiation means. When a fiber is used for irradiation means, (i) the diameter of fiber core is adjustable.

Since the device of the present invention includes the suitable laser oscillation means, laser transmission means and laser irradiation means, rock may be processed by breakdown without rock fusion. Further, by adding the laser wavelength conversion means to the device of the present invention, the process may be more suitably carried out.

An embodiment of the present invention, now, will be explained with reference to the drawings.

Figure 2A:
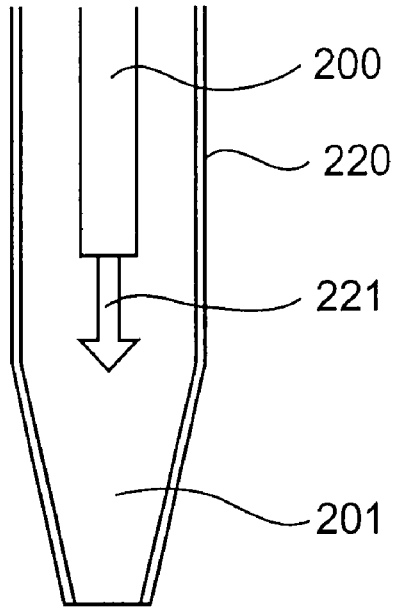
FIG. 2 (*a*) is a schematic diagram illustrating a process for generating a jet by laser irradiation in liquid.
Figure 2B:
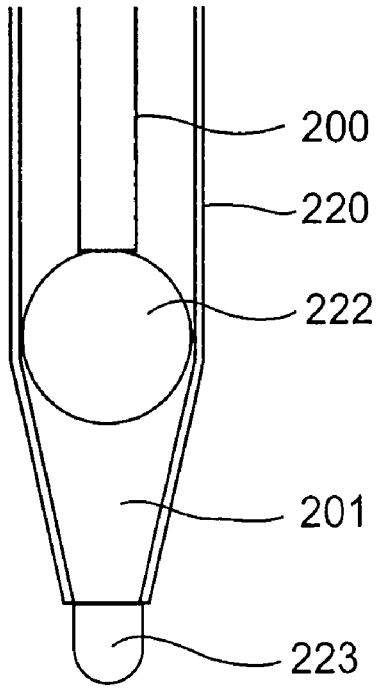
Figure 2C:
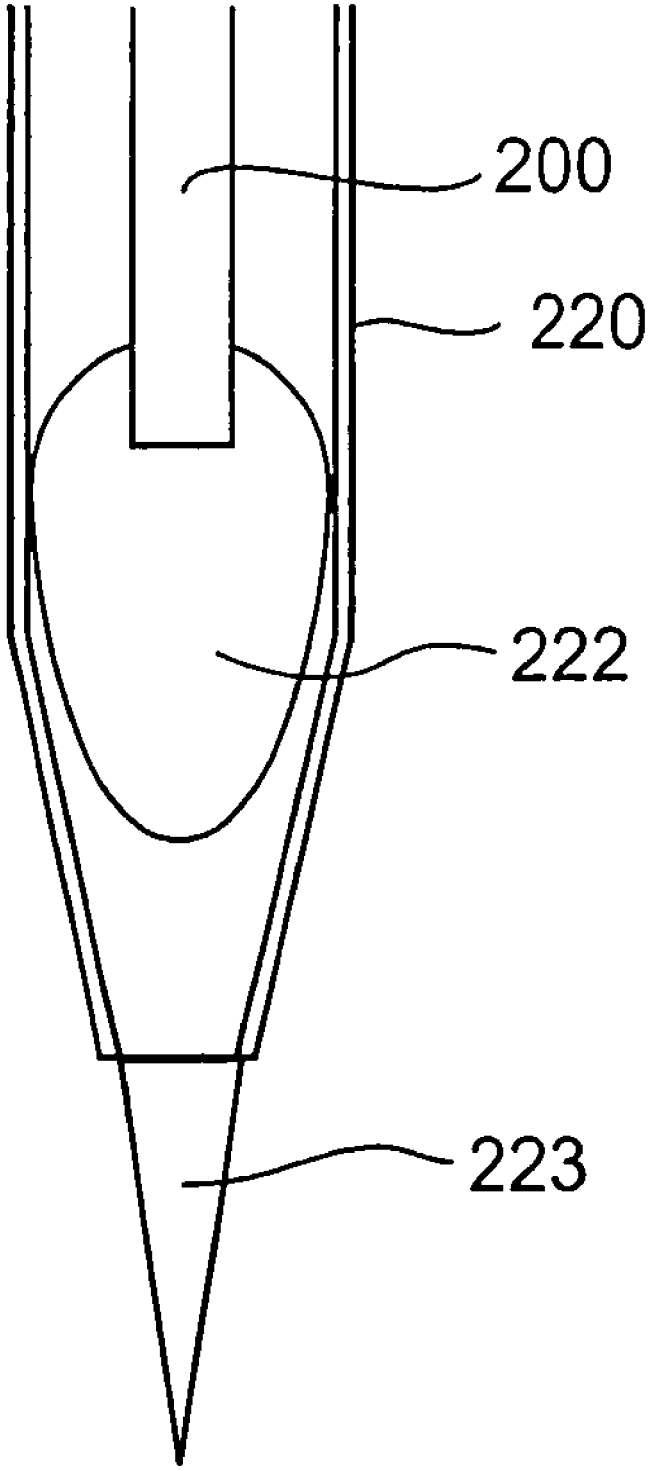
Figure 3:
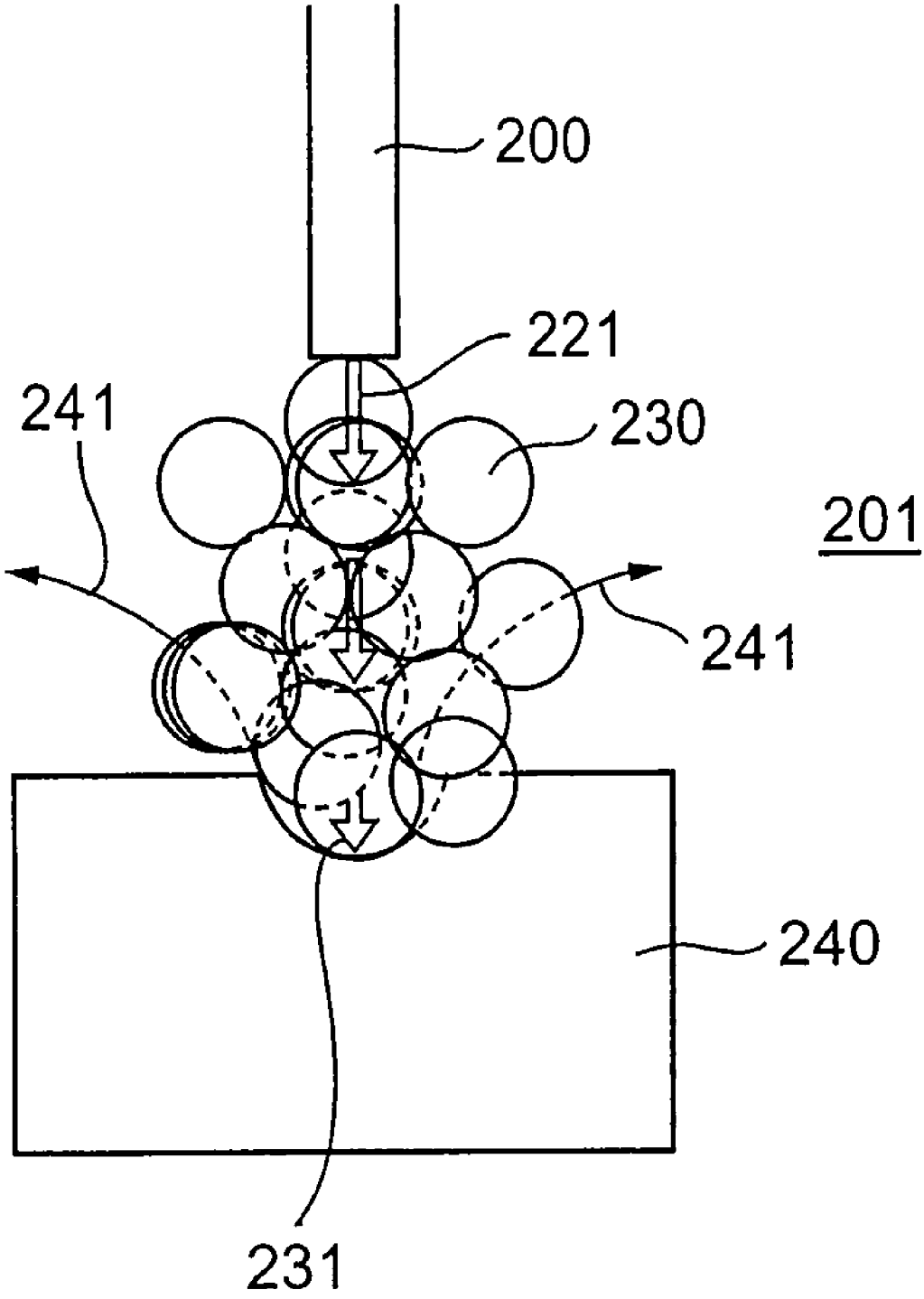
FIG. 3 is a schematic diagram illustrating laser propagation by a cavitation effect.

FIG. 1 (*a*) to FIG. 1 (*d*) are schematic diagrams illustrating a process for generating a laser-induced shock wave. FIG. 2 (*a*) to FIG. 2 (*c*) are schematic diagrams illustrating a process for generating a laser-induced jet stream. FIG. 3 is a schematic diagram illustrating a process for generating a laser-induced bubble flow.

When a large amount of energy is applied in liquid over a short time period, a bubble is created due to rapid evaporation of the liquid, forming a shock wave in the liquid. Such an energy source includes discharge or explosion except for laser irradiation. In the present invention, this phenomenon is caused by using laser irradiation and a laser-induced force is generated.

A process for generating a shock wave in liquid by using laser irradiation is as follows. That is, as shown in FIG. 1(*a*), a pulsed laser beam is irradiated in liquid from the front end of an optical fiber 200 to a liquid 201, then plasma 202 is generated due to short time absorption of thermal energy contained in the laser beam by the liquid, producing strong shock waves 203,204 in a high-temperature and pressure state. Also, as shown in FIG. 1(*b*), a bubble 210 is created, grown up and contracts. FIG. 1(*c*) shows that the bubble 210 is in a contracted state. In this process, as shown in FIG. 1(*d*), when energy is again supplied by laser irradiation, the bubble 210 is re-expanded rapidly, generating the shock waves 203, 204 circumferentially along with the plasma 202.

In order that a laser is absorbed efficiently by liquid, it is required for an oscillation wavelength of the laser to approximate an absorption wavelength of the liquid. When a laser has a wavelength near a range of optical absorption wavelength of liquid, energy may be absorbed efficiently by an object having a large rate of content of liquid and in such an object, a shock wave and bubble may be efficiently generated.

FIG. 2(*a*) to FIG. 2(*c*) show the principle of a process for generating a laser-induced jet. As shown in FIG. 2(*a*), when an optical fiber 200 is disposed within a tube 220 filled with liquid 201 and a laser beam 221 having high absorptance of the liquid is irradiated through the optical fiber 200, as shown in FIG. 2(*b*), a bubble 222 is generated within the tube by the laser beam and the bubble 222, then, pushes out the liquid 201 from the tube, generating a jet 223.

Thus, as shown in FIG. 2 (*c*), rapid expansion of the bubble 222 may project a jet 224. The jet 224 is dependent on laser energy and a jet strength may be changed by change in the laser energy.

FIG. 3 shows circumstances where irradiation of a pulsed laser beam 221 in liquid 201 through a fiber 200 generates a number of bubbles 230, then, the laser beam 221 passes through the bubbles 230 created and a laser beam 231 reaches a stratum. The laser beam 231 which has passed through may break down the stratum 240 and scatter spalls 241, excavating the stratum 240.

As shown in FIG. 3, when a laser beam is irradiated at high strength from the output end of the fiber 200 into the liquid 201, the bubbles 230 are created near the output end, and even if the liquid 201 is opaque, the laser beam 231 can pass through the bubbles 230, irradiating the submerged stratum (rock) 240 with the laser beam. Therefore, when a pulsed laser beam 221 is irradiated at a larger repetition frequency before the bubbles 230 created dissolve, the bubbles 230 can maintain an irradiation path of the laser beam 231.

Therefore, in the present invention, by employing this means, it becomes possible to irradiate directly the stratum 240 in the liquid 201 with the laser beam 231, excavating the stratum, not only in transparent liquid but also in opaque liquid.

Figure 4:
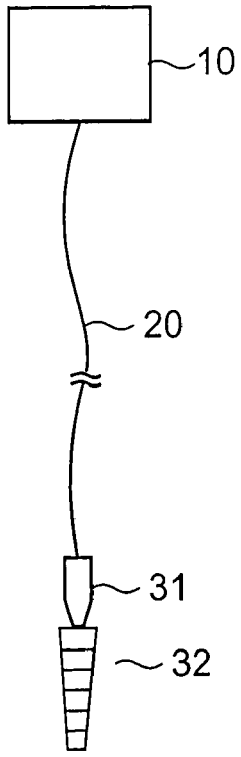
FIG. 4 is a schematic depiction illustrating an example.
Figure 5:
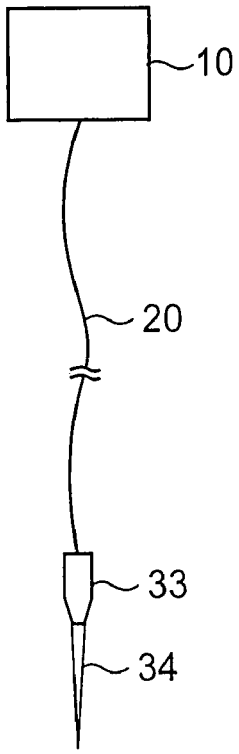
FIG. 5 is a schematic depiction illustrating an example.
Figure 6:
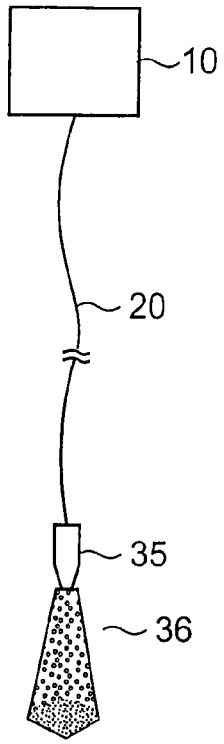
FIG. 6 is a schematic depiction illustrating an example.
Figure 7:
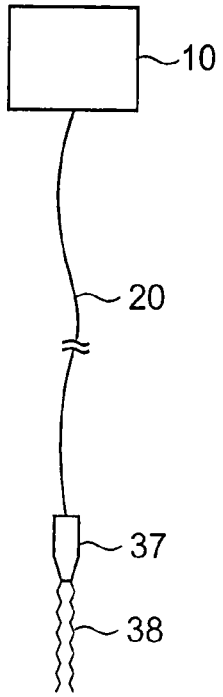
FIG. 7 is a schematic diagram illustrating a configuration of a device of an example.

FIGS. 4-8 illustrate generation of a laser-induced force. In each of FIGS. 4-8, a laser beam generated by laser oscillation means 10 is transmitted to liquid through laser transmission means 20, and irradiated in the liquid. In FIG. 4, the laser beam generated is transmitted to laser-induced shock wave generation means 31, which generates a laser-induced shock wave 32. In FIG. 5, the laser beam generated is transmitted to laser-induced jet generation means 33, which generates a laser-induced jet 34. In FIG. 6, the laser beam generated is transmitted to laser-induced jet generation means 35, which generates a laser-induced bubble flow 36. In FIG. 7, the laser beam generated is transmitted to laser-induced acoustic wave generation means 37, which generates a laser-induced acoustic wave 38.

Figure 8:
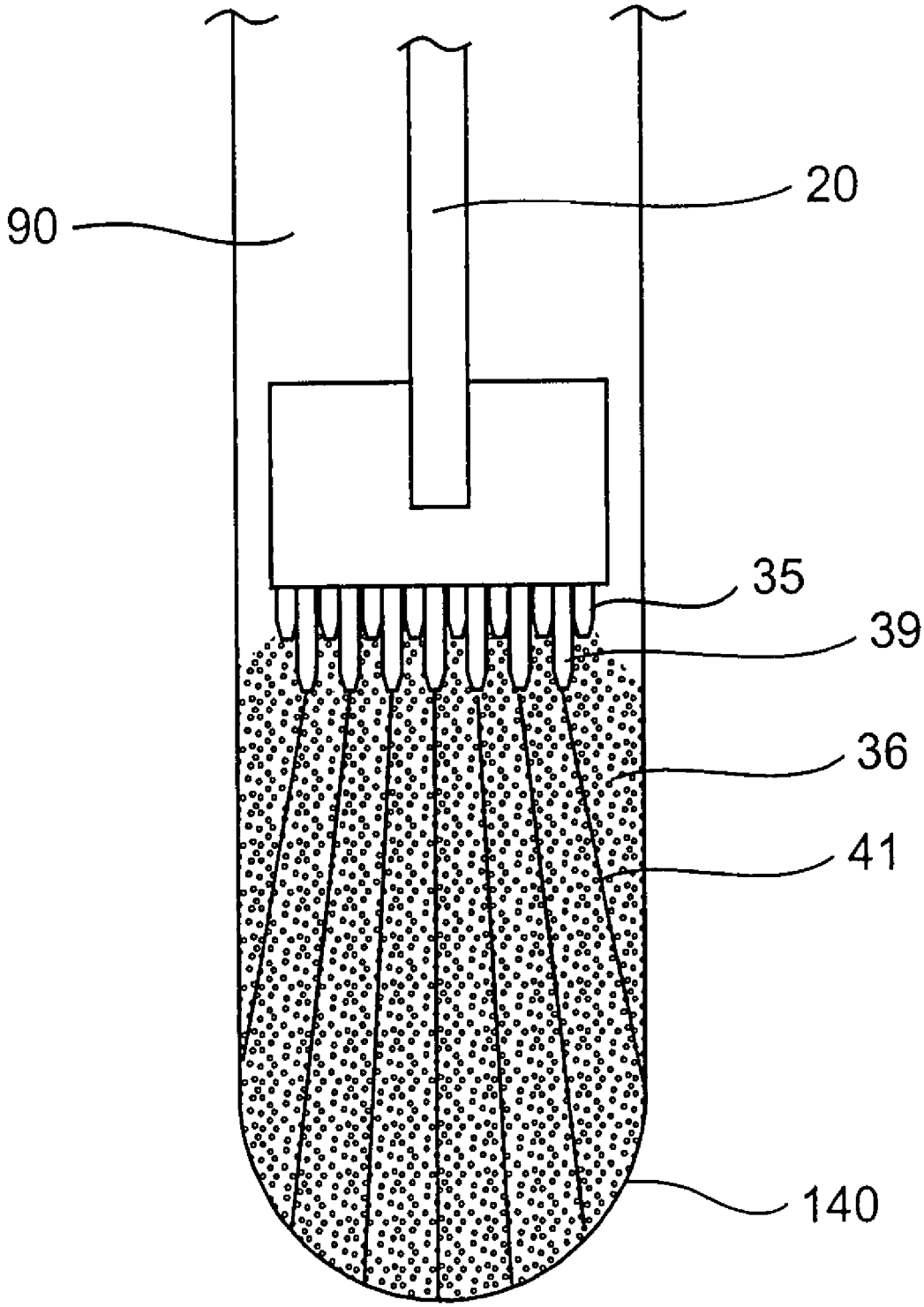
FIG. 8 is a schematic diagram illustrating a configuration of a device by way of example.

FIG. 8 is a schematic diagram illustrating cooperation between a first laser for generating a laser-induced force and a second laser which passes through a bubble. As shown in FIG. 8, a laser beam (a first laser) having a wavelength at which the laser beam is highly absorbed by liquid 90 is transmitted through the laser transmission means 20 to reach the laser-induced bubble flow generation means 35. Also, a laser beam (a second laser 41) which is less absorbed by the liquid is transmitted through the laser transmission means 20 to reach laser irradiation means 39. The laser beam (the second laser 41) irradiated by the laser irradiation means 39 passes through an open hole region in a bubble flow 36 generated by the laser-induced bubble flow generation means 35 to reach a stratum 140, irradiating the stratum 140 with the laser beam. A laser having low absorptance of liquid is selected as the second laser 41, resulting in higher transmittance of the laser beam which may reach the stratum 140. The second laser 41 which has passed through the liquid can destroy rock due to a thermal effect which rapidly heats the stratum 140, excavating the stratum 140.

Figure 9:
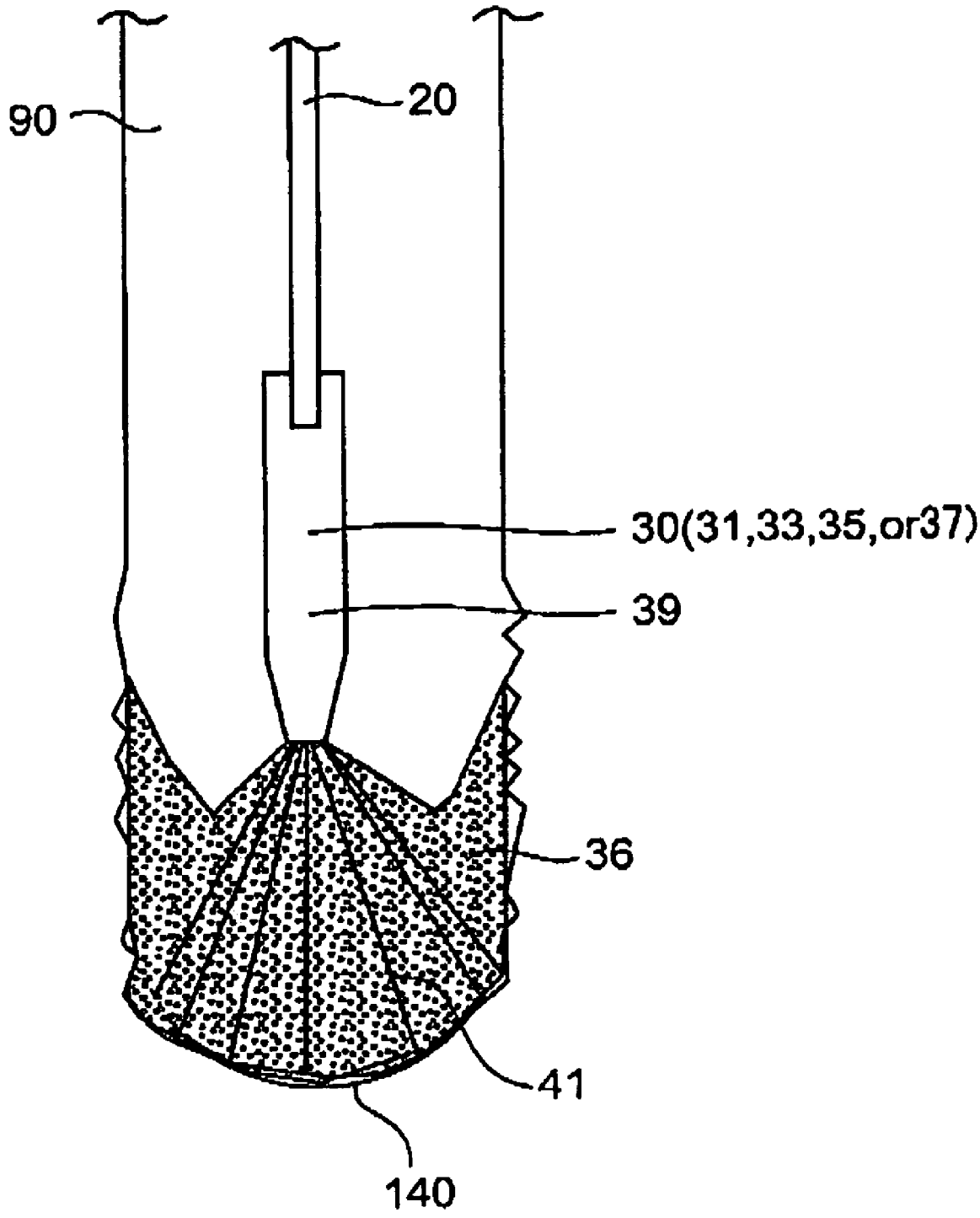
FIG. 9 is a schematic diagram illustrating a configuration of a device by way of example.

FIG. 9 is a schematic diagram illustrating excavation by using cooperation between the laser-induced force of the first laser and the thermal effect of the second laser. A pulsed laser beam transmitted through laser transmission means 20 is irradiated in liquid 90 via laser irradiation means 30 (laser-induced shock wave generation means 31, laser-induced jet generation means 33, laser-induced acoustic wave generation means 35 or laser-induced bubble flow generation means 37), thereby generating the laser-induced force of the first laser.

Further, the second laser 41 which is generated by laser irradiation means 39 and passed through the laser-induced bubble flow 36 has also an effect capable of excavating the stratum 140 due to the thermal effect. Therefore, excavation of the stratum 140 may be carried out by using cooperation between both of the effects. Excavation of the stratum 140 may be carried out efficiently by working both of the first laser-induced force generated by the laser irradiation means 30 as mechanical force to excavate a stratum (rock), and destruction effect of the stratum created due to the thermal effect caused by the second laser 41 which is generated by the laser irradiation means 39 and passed through the bubble flow 36 to reach the stratum.

Figure 10:
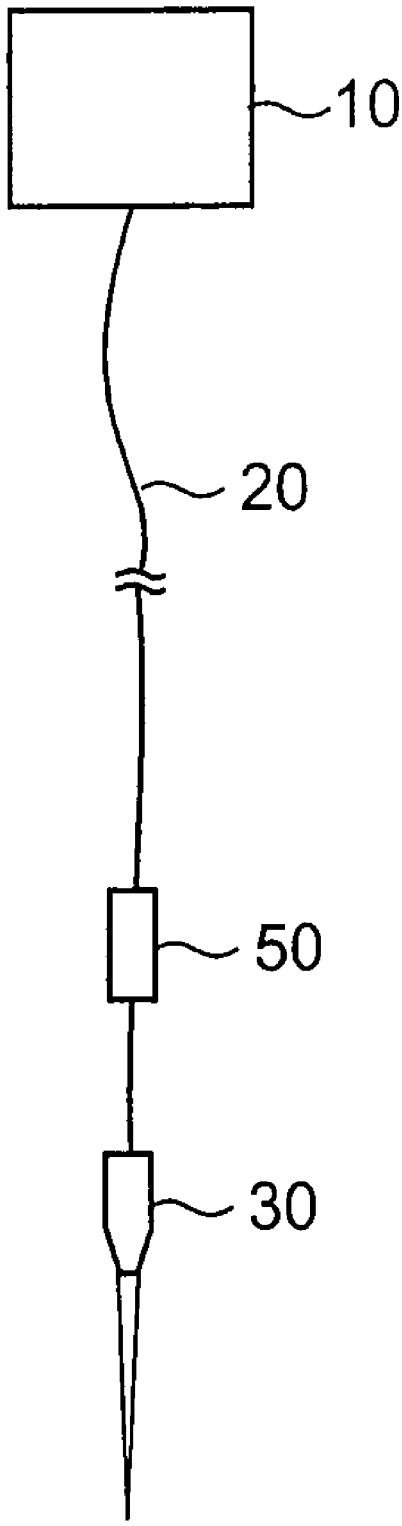
FIG. 10 is a schematic diagram illustrating a configuration of a device by way of example.

FIG. 10 shows an excavation device of an example including laser wavelength conversion means 50. This device includes laser oscillation means 10 and laser transmission means 20, laser wavelength conversion means 50 and laser irradiation means 30, which allows laser-induced force to be generated. The reason why the laser wavelength conversion means 50 is used is because, in order to reduce transmission loss due to the laser transmission means 20, a laser wavelength generated by the laser oscillation means 10 may be set to a wavelength at which the transmission loss is made smaller. A laser beam which reaches the laser wavelength conversion means 50 is converted to a laser beam having a wavelength at which the laser beam is highly absorbed by liquid, enhancing generation efficiency of the laser-induced force. Alternately, after being converted to a laser beam having a wavelength at which the laser beam is absorbed less by the liquid, the laser beam may be transmitted through the liquid as much as possible to reach the stratum 140. Use of the laser wavelength conversion means 50 allows control of generation efficiency in the laser-induced phenomenon.

Figure 11:
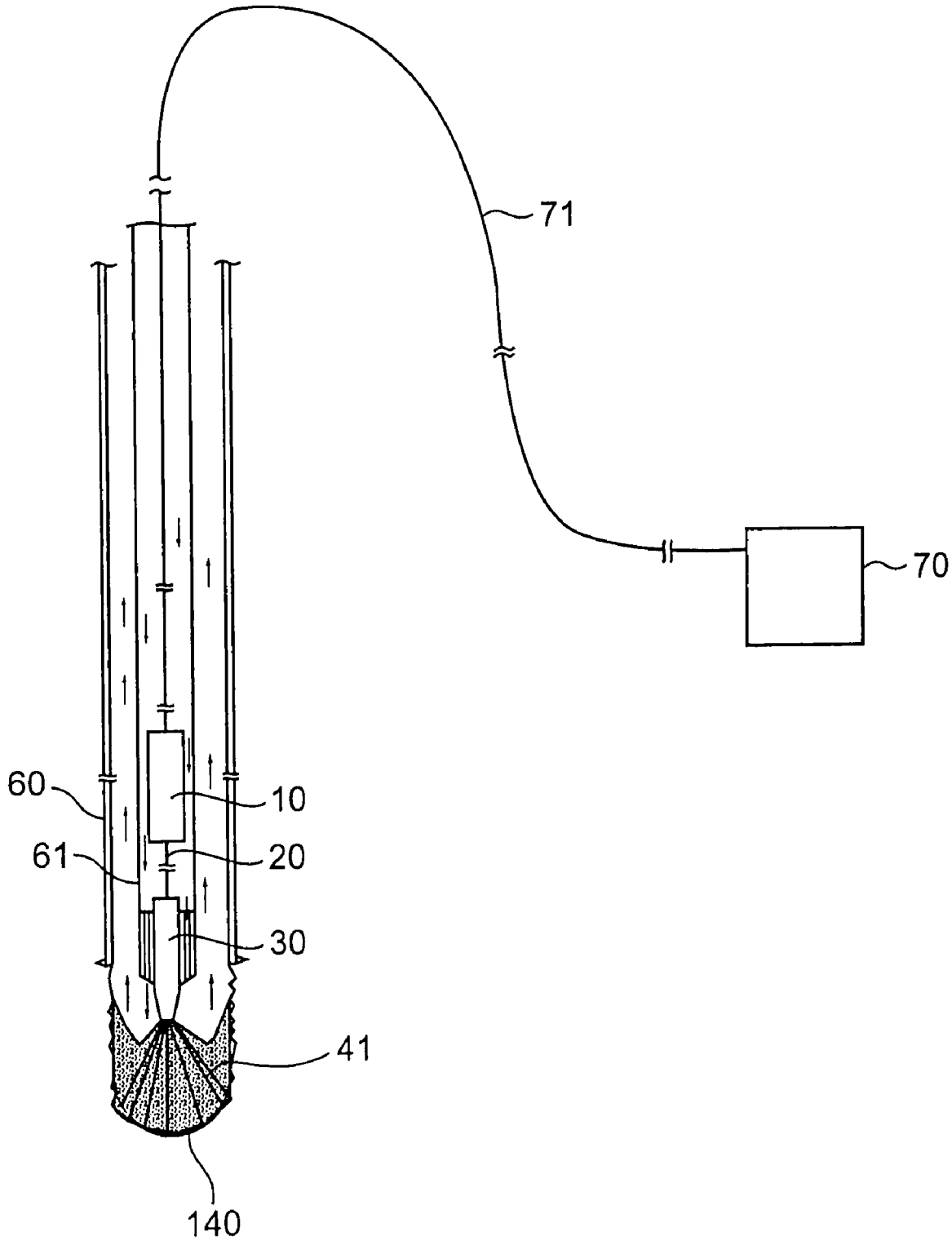
FIG. 11 is a schematic diagram illustrating a configuration of a device by way of example.

FIG. 11 shows a device of an example including laser oscillation means 10 disposed inside a pipe 61 provided in a well 60. Electric power is supplied to the laser oscillation means 10 by power supply means 70 through an electric cable 71. A laser beam generated by the laser oscillation means 10 disposed inside the pipe 61 in the well 60 is transmitted through laser transmission means 20 to laser irradiation means 30, generating laser-induced force. Further, a laser beam (a second laser 41) which is less absorbed by liquid may be directly irradiated on a stratum 140 as a transparent laser beam. Further, the laser-induced force according to the first laser and the transparent laser beam formed of the second laser may be cooperatively worked to excavate the stratum 140.

In this example, when transmission loss of a laser beam generated by the laser oscillation means 10 caused from transmission through the laser transmission means 20 is large, the power cable 71 may be extended to make the laser transmission means 20 as short as possible, reducing the laser transmission loss. According to this example, the transmission loss of laser energy generated by the laser oscillation means 10 may be reduced to transmit the laser energy to the laser irradiation means 30. Therefore, the energy for generating the laser-induced force may be fully utilized.

Figure 12:
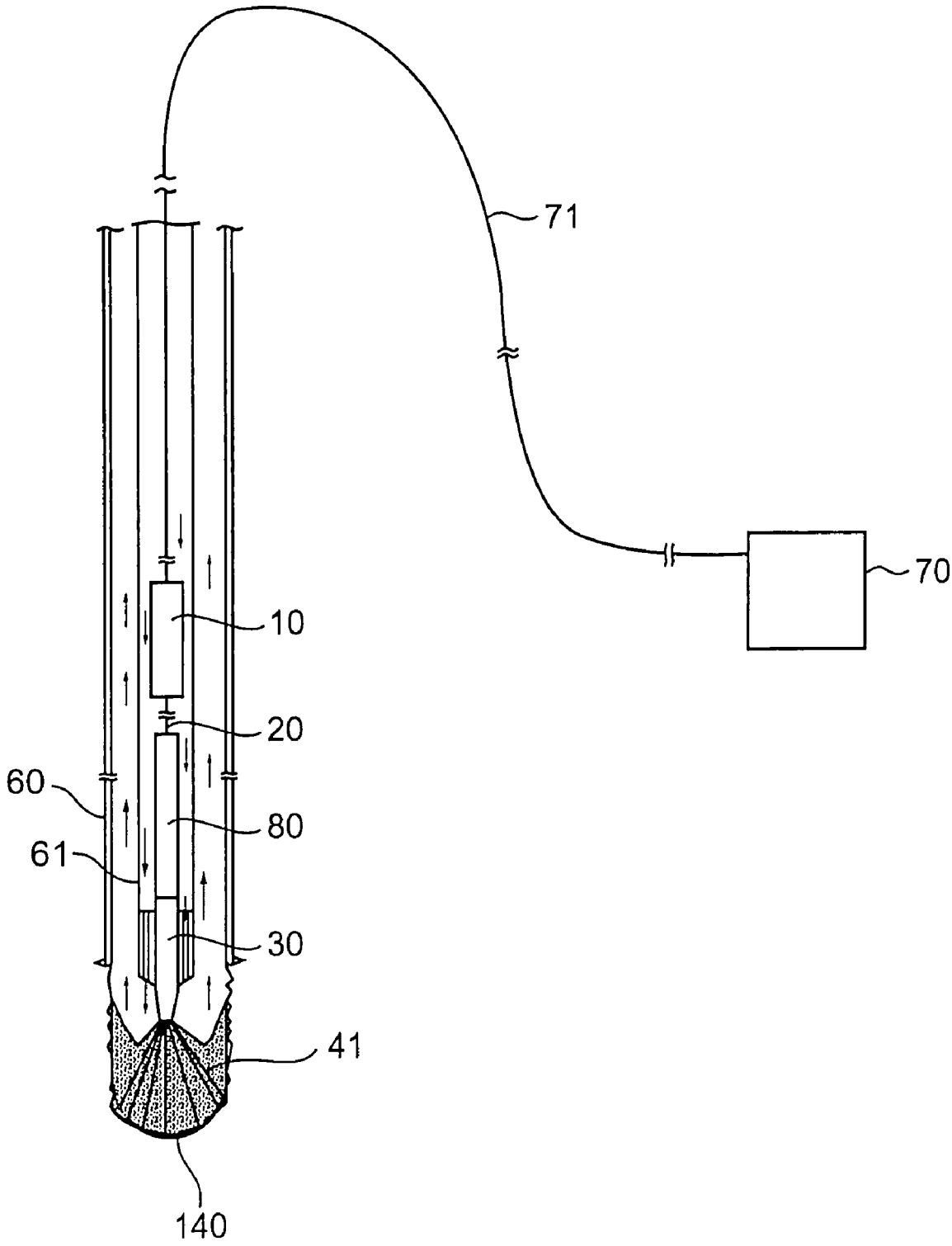
FIG. 12 is a schematic diagram illustrating a configuration of a device by way of example.

FIG. 12 shows another example, which is composed of power supply means 70, an electric cable 71, laser oscillation means 10, laser transmission means 20, laser pulse compression means 80 and laser irradiation means 30.

Electric power supplied by the power supply means 70 is provided to the laser oscillation means 10 through the electric cable 71. After a laser beam generated by the laser oscillation means 10 disposed inside a pipe 61 positioned in a well 60 is compressed to a laser beam having a high peak output by the laser pulse compression means 80, the laser beam is irradiated by the laser irradiation means 30 to generate laser-induced force. Further, when a laser having low absorptance of liquid is used, it may become a transparent laser (a second laser 41), directly irradiating a stratum 140 with the laser beam. Moreover, a first laser for generating the laser-induced force and the second laser (the transparent laser) may be cooperatively worked to excavate a stratum.

In this example, laser transmission loss is not only reduced by extending the electric cable 71 and shortening the laser transmission means 20 as short as possible, but after the laser beam is compressed by the laser pulse compression means 80 to a laser beam having a high peak output, the laser beam is irradiated by the laser irradiation means 30 to generate more efficiently the laser-induced force. Thus, excavation efficiency of a stratum can be enhanced.

Figure 13:
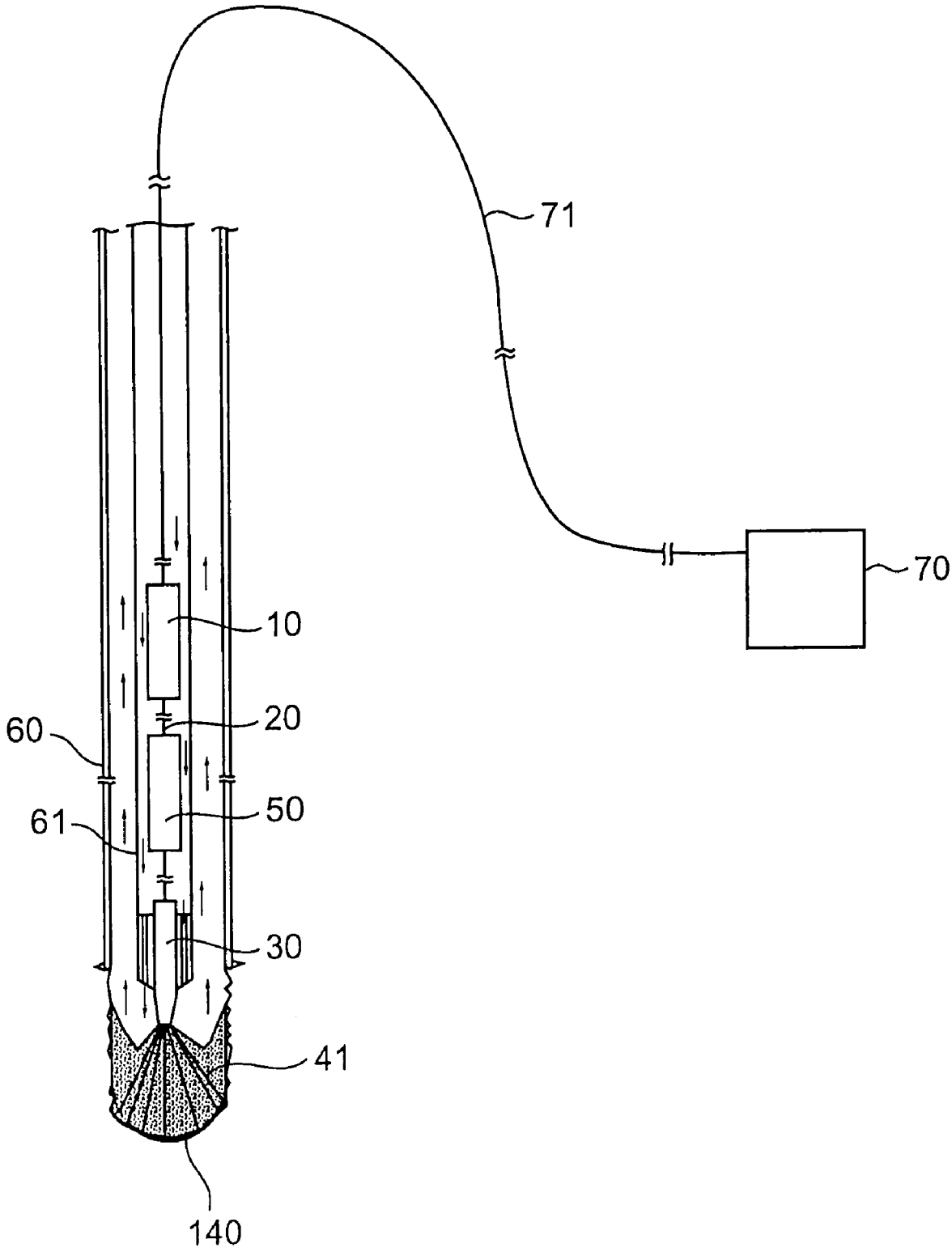
FIG. 13 is a schematic diagram illustrating a configuration of a device by way of example.

FIG. 13 shows an example including laser wavelength conversion means 50.

Electric power is supplied to laser oscillation means 10 by power supply means 70 through an electric cable 71. A laser beam generated by the laser oscillation means 10 disposed inside a pipe 61 positioned in a well 60 is transmitted through laser transmission means 20. A laser beam which reached the laser wavelength conversion means 50 is converted to a laser beam having a wavelength with high absorptance of liquid, which reaches laser oscillation means 30 and is irradiated by the laser oscillation means 30, allowing generation efficiency of laser-induction to be enhanced. Further, by converting the laser beam by the laser wavelength conversion means 50 to a laser beam (a second laser 41) having low absorptance of liquid and enhancing its transmittance in liquid, it is allowed to transmit the laser beam as much as possible to reach a stratum 140. Therefore, energy loss of the second laser 41 which reaches the stratum 140 may be reduced. Thus, the laser-induced force and the thermal effect for breakdown according to the second laser may be cooperatively worked to enhance excavation efficiency of the stratum 140.

Figure 14:
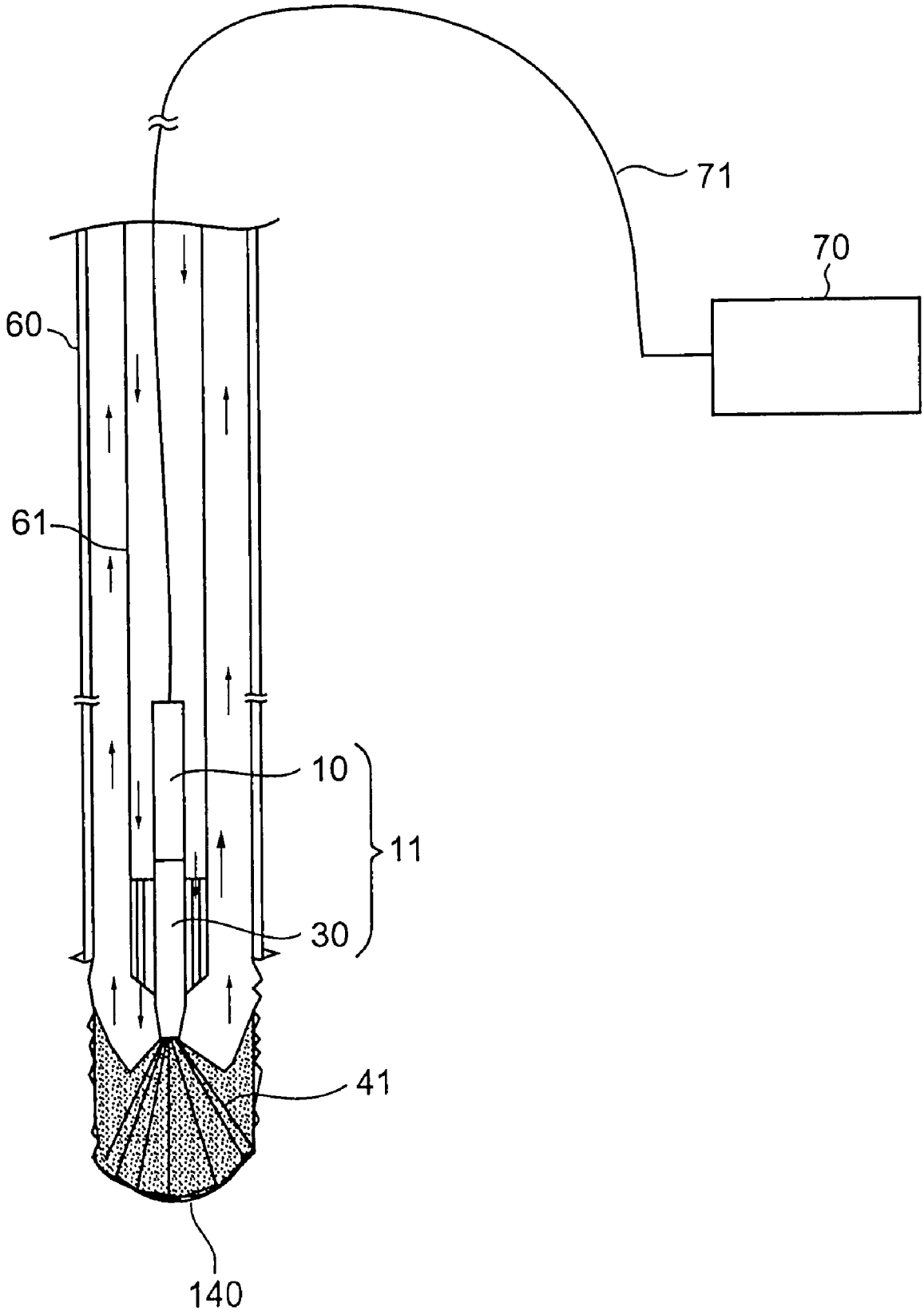
FIG. 14 is a schematic diagram illustrating a configuration of a device by way of example.

FIG. 14 shows an example in which a laser bit 11 composed of laser oscillation means 10 and laser irradiation means 30 is provided in an open end of a well 60, and this laser bit 11 is disposed inside a pipe 61 positioned in the well 60.

Electric power supplied by power supply means 70 is provided to the laser oscillation means 10 through an electric cable 71. A laser beam generated by the laser oscillation means 10 is irradiated by the laser irradiation means 30. Laser irradiation allows laser-induced force to be generated and a laser beam having low absorptance of liquid to be transmitted through liquid. A first laser for generating the laser-induced force and a second laser 41 which has passed through a bubble may be cooperatively worked to excavate a stratum 140.

Figure 15:
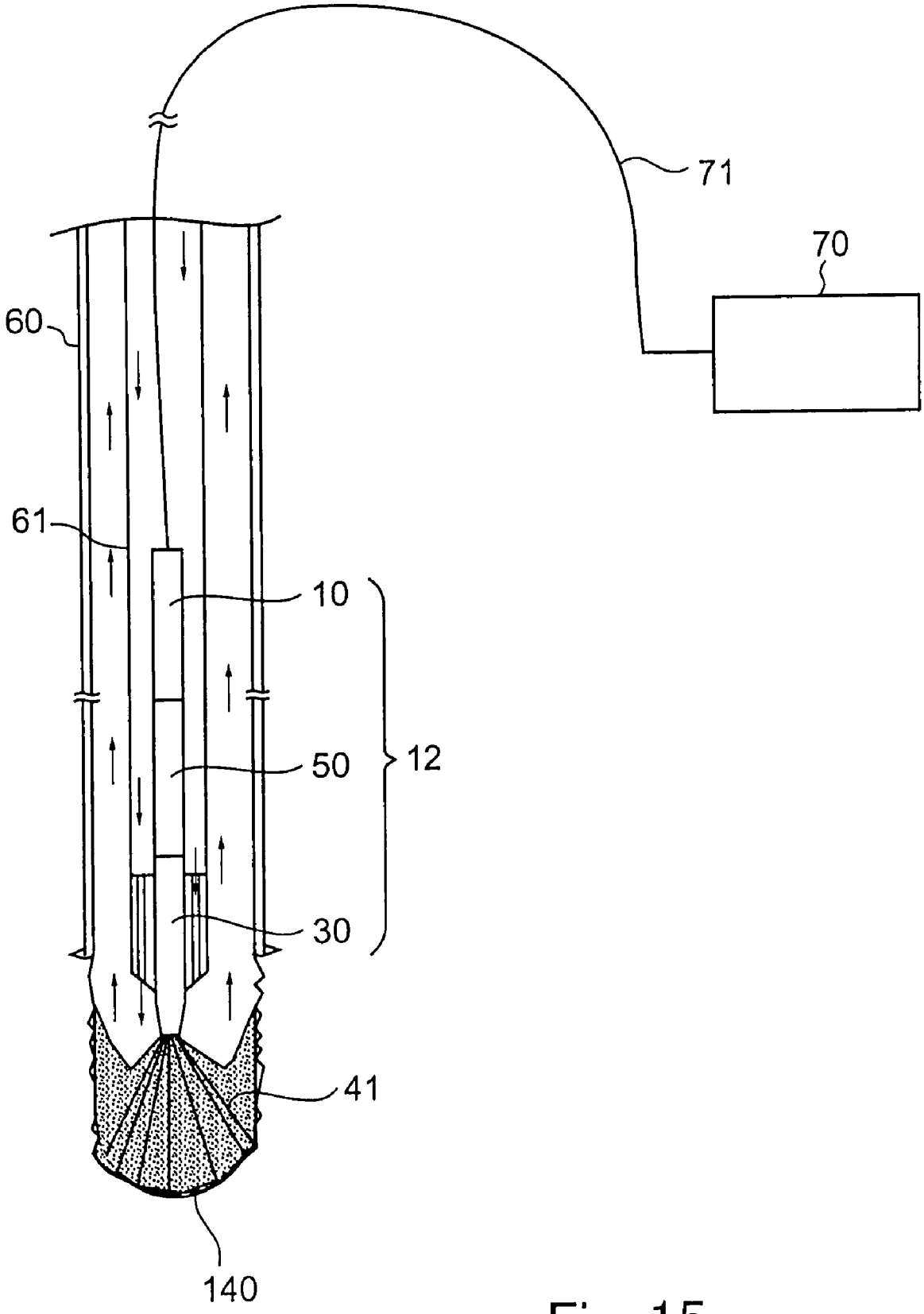
FIG. 15 is a schematic diagram illustrating a configuration of a device by way of example.

FIG. 15 shows an example in which a laser bit 12 composed of laser oscillation means 10, laser means 50 and laser wavelength conversion and irradiation means 30 is provided in a front end of a pipe 61 disposed in a well 60. Electric power supplied by power supply means 70 is provided to the laser oscillation means 10 through an electric cable 71. A laser beam generated by the laser oscillation means 10 is converted by the laser wavelength conversion means 50 to a laser beam having a wavelength with high absorptance of liquid. This laser beam (a first laser) may be irradiated in liquid by the laser irradiation means 30, generating laser-induced force. Alternately, the laser beam may be converted by the laser wavelength conversion means 50 to a laser beam (a second laser) having a wavelength with low absorptance of liquid and passed through a bubble to reach a stratum 140. Effects according to the lasers having these two types of wavelengths may be cooperatively worked to excavate the stratum 140.

Figure 16:
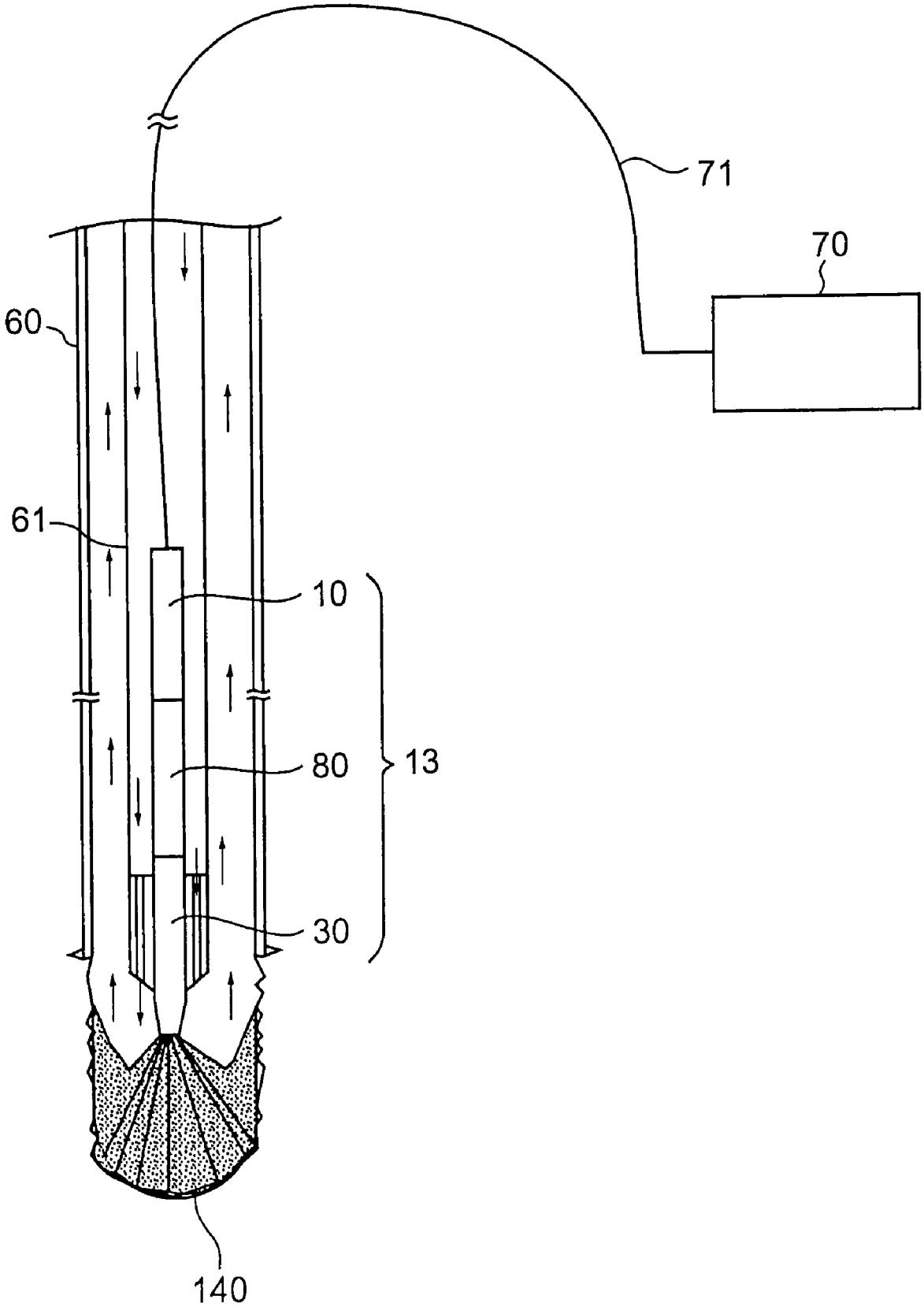
FIG. 16 is a schematic diagram illustrating a configuration of a device by way of example.

FIG. 16 shows an example in which a laser bit 13 composed of laser oscillation means 10, laser pulse compression means 80 and laser irradiation means 30 is provided, and this laser bit 13 is disposed inside a pipe 61 positioned in a well 60. Electric power supplied by power supply means 70 is provided to the laser oscillation means 10 through an electric cable 71. After a laser beam generated is compressed by the laser pulse compression means 80 to a laser beam having a high peak output, this laser beam may be irradiated in liquid by the laser irradiation means 30, generating laser-induced force. Further, the laser pulse compression means 80 can increase a peak output of a laser pulse for generating the laser-induced force, enhancing excavation efficiency of a stratum 140.

Figure 17:
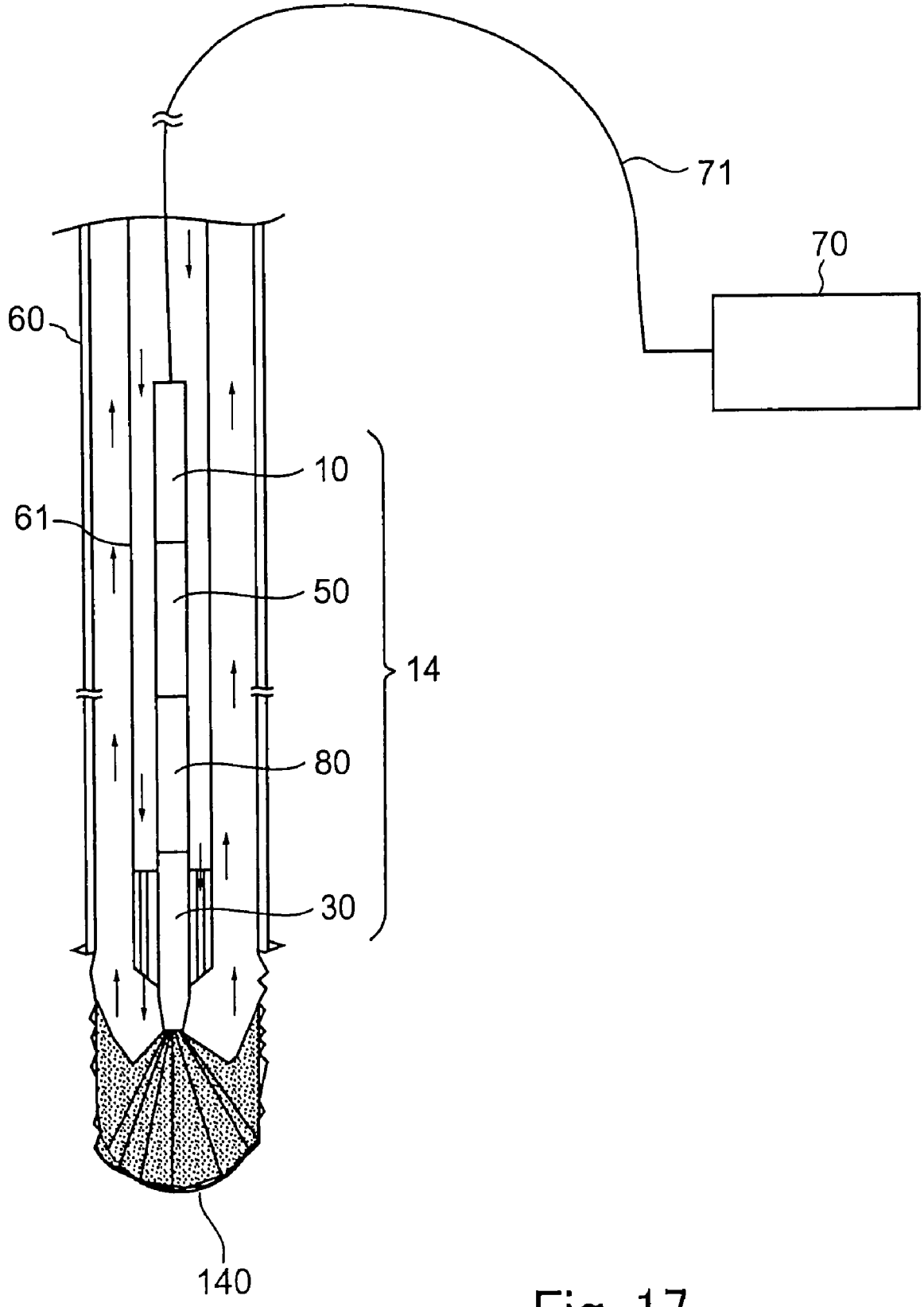
FIG. 17 is a schematic diagram illustrating a configuration of a device by way of example.

FIG. 17 shows an example in which a laser bit 14 composed of laser oscillation means 10, laser wavelength conversion means 50, laser pulse compression means 80 and laser irradiation means 30 is provided, and this laser bit 14 is disposed inside a pipe 61 positioned in a well 60. Electric power supplied by power supply means 70 is provided to the laser oscillation means 10 through an electric cable 71. After a laser beam generated is converted by the laser wavelength conversion means 50 to a laser beam having a wavelength with high absorptance of liquid, this laser beam is compressed by the laser pulse compression means 80 to a laser having a high peak output, which may be irradiated in liquid by the laser irradiation means 30, generating laser-induced force efficiently.

According to this example, the laser beam may be converted by the laser wavelength conversion means 50 to a second laser having high absorptance of liquid, which further may be compressed by the laser pulse compression means 80 to a laser beam having a high peak output, thereby generating laser-induced force efficiently. Thus, excavation efficiency of the stratum 140 can be enhanced.

Figure 18:
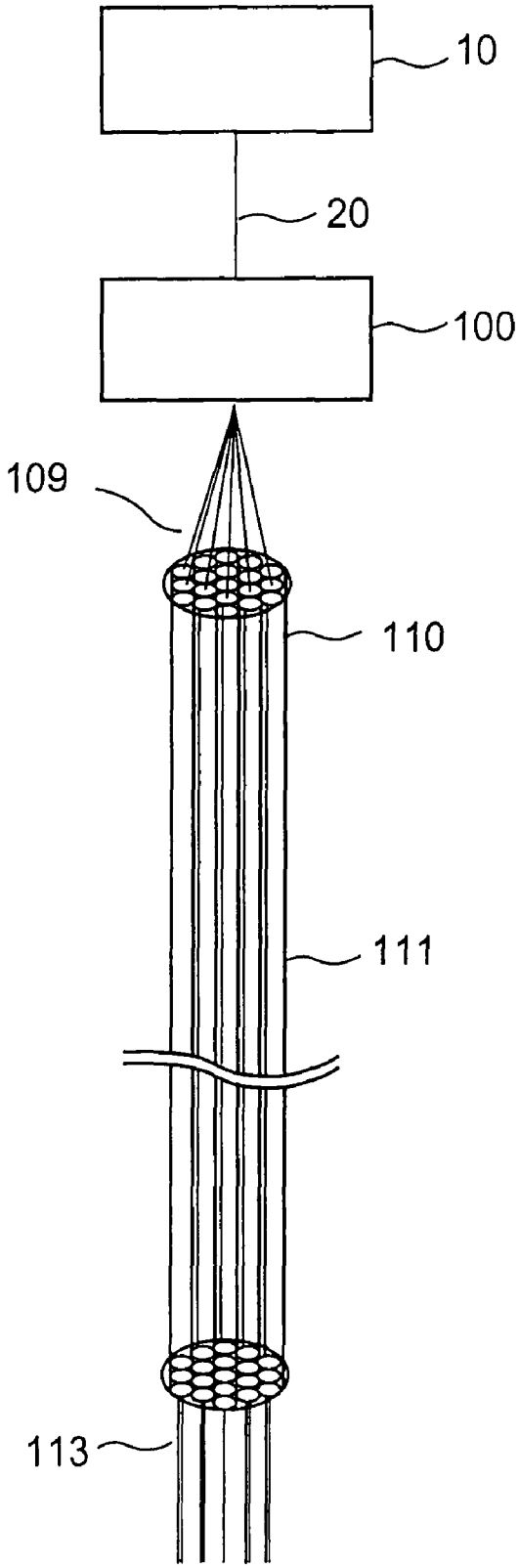
FIG. 18 is a schematic diagram illustrating a configuration of a device by way of example.

FIG. 18 shows another example, and in this example, a laser beam generated by laser oscillation means 10 is transmitted through laser transmission means 20 to emission means 100 for irradiating plural fibers. Then, a laser beam 109 is irradiated on a multicore fiber 111 composed of plural single-fibers 110 by the emission means 100 for irradiating plural fibers in a beam steering mode or beam scanning mode. A laser beam transmitted through the multicore fiber 111 forms an outgoing laser beam 113.

Figure 19:
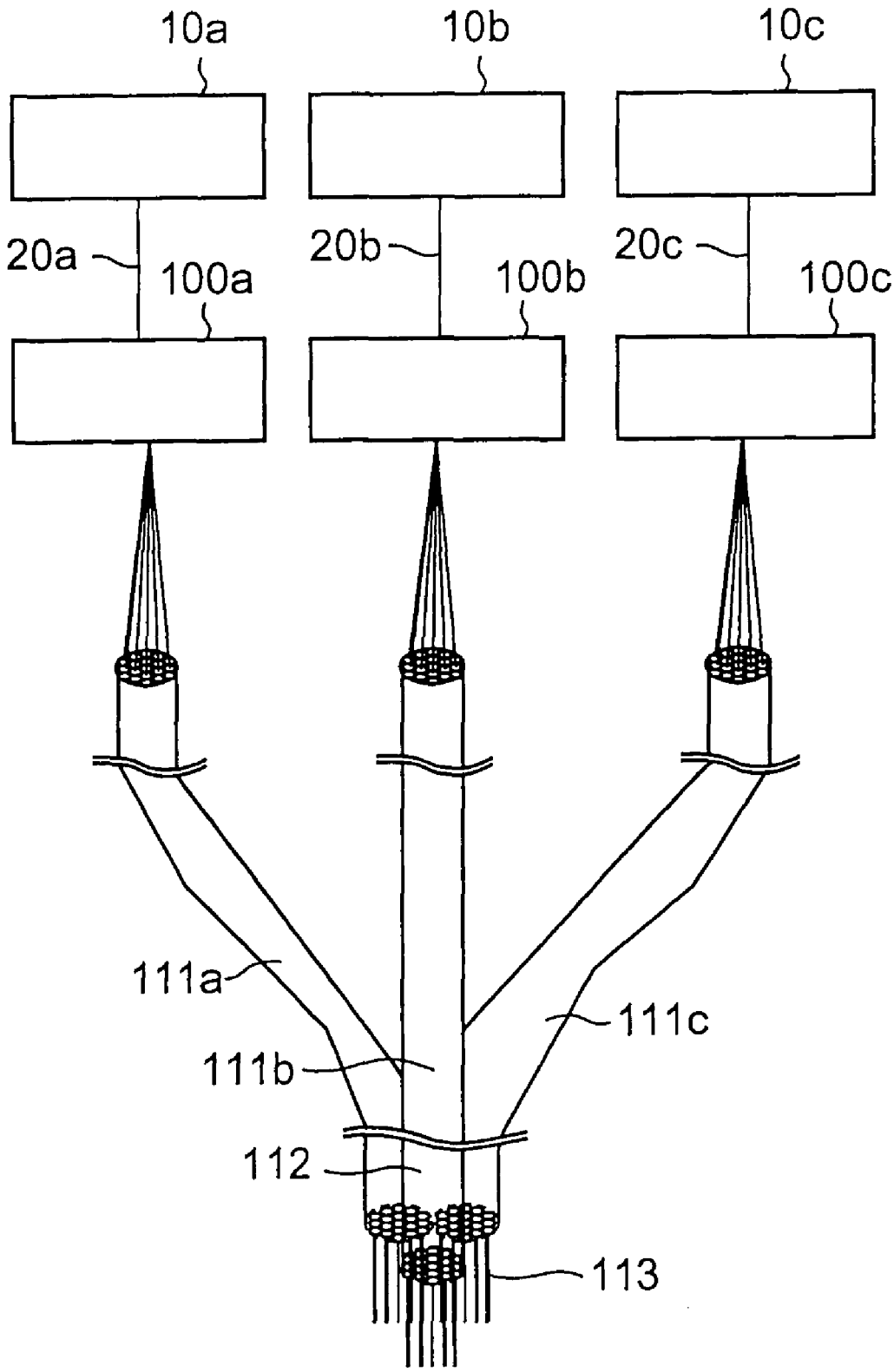
FIG. 19 is a schematic diagram illustrating a configuration of a device by way of example.

FIG. 19 shows an example in which laser beams generated by plural laser oscillation means 10*a*, 10*b* and 10*c* are each transmitted through laser transmission means 20*a*, 20*b* and 20*c* to laser emission means 100*a*, 100*b* and 100*c*. These laser emission means 100*a*, 100*b* and 100*c* irradiate multicore fibers 111*a*, 111*b* and 111*c* composed of plural fibers with the laser beams.

The multicore fibers 111*a*, 111*b* and 111*c* are assembled to constitute a bundle fiber 112 (laser transmission means 22). Increase in the number of fiber bundles of the bundle fiber 112 may allow irradiation energy to be enhanced. In addition, the assembled multicore fibers are considered to be a bundle fiber, but a multicore fiber itself may be a type of bundle fiber.

According to the configuration, a large amount of output energy can be transferred to a stratum to excavate without overloading a single fiber.

Figure 20:
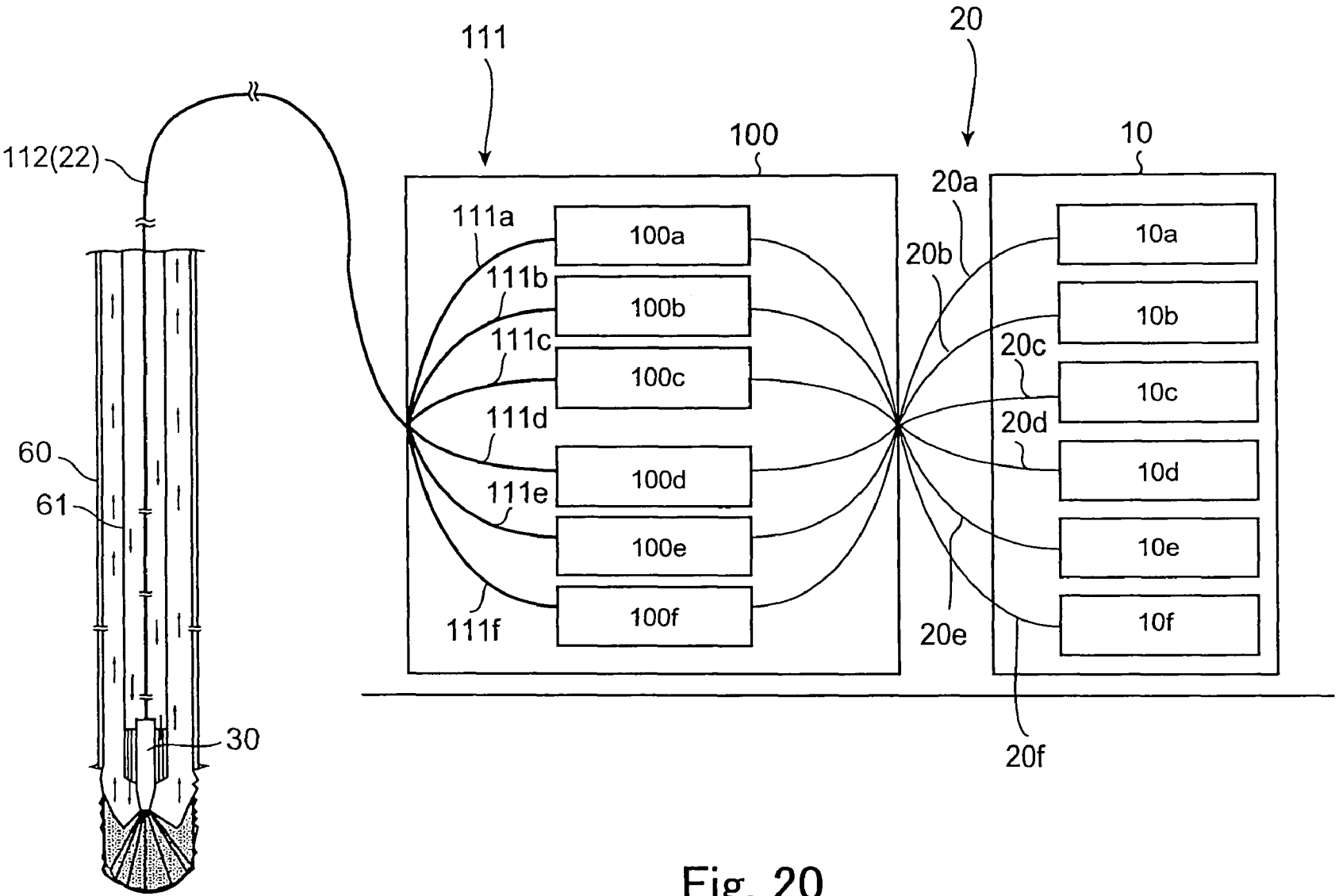
FIG. 20 is a schematic diagram illustrating a configuration of a device by way of example.

FIG. 20 shows another example. Laser beams generated by laser oscillation means 10 composed of plural laser oscillation means 10*a*, 10*b*, 10*c*, 10*d*, 10*e* and 10*f* are each transmitted through laser transmission means 20 (a group consisting of a single fiber) composed of single fibers 20*a*, 20*b*, 20*c*, 20*d*, 20*e* and 20*f* to laser emission means 100 for irradiating plural fiber bundles, for example, multicore fibers 111. The laser emission means 100 is composed of an individual laser emission means 100*a*, 100*b*, 100*c*, 100*d*, 100*e* and 100*f*. These individual laser emission means each irradiate multicore fibers 111*a*, 111*b*, 111*c*, 111*d*, 111*e* and 111*f* (laser transmission means) with a laser beam. Then, the laser beams transmitted through these multicore fibers 111 are collected to be passed through a bundle fiber 112 (laser transmission means 22) to laser irradiation means 30.

The laser transmission means 22 is composed of the bundle fiber 112 formed by assembling the multicore fibers 111 including plural fibers packed into a bundle. The laser beams generated by a group of many oscillation means 10 are directed through the laser transmission means 20 composed of a single fiber to the emission means 100 and then directed to the laser transmission means composed of the multicore fibers 111. Further, the laser beams reach the laser irradiation means 30 through the bundle fiber 112 formed by assembling the multicore fibers 111. A laser beam having a large output irradiated by the laser irradiation means 30 produces laser-induced force having a large output. This transparent laser beam having a large output creates a thermal breakdown effect, which is used for a large scale excavation of a stratum.

In the example shown in FIG. 20, laser energy transferred by a single fiber may be made small, and required energy, therefore, may be transferred within an allowable range of fiber. Thus, use of a bundle fiber as the laser transmission means 22 may allow laser energy of a large output to be transferred and utilized.

Figure 21:
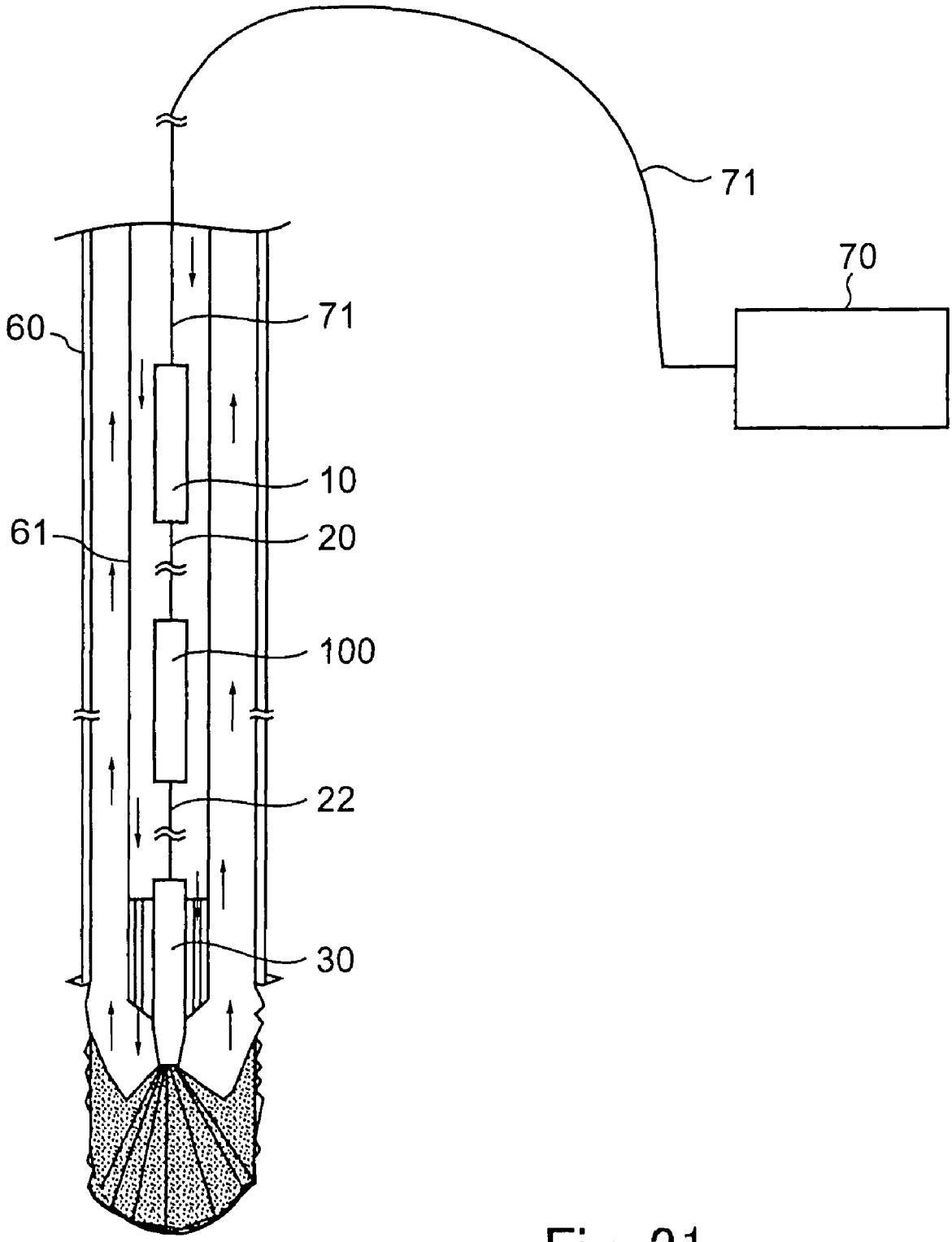
FIG. 21 is a schematic diagram illustrating a configuration of a device by way of example.

FIG. 21 shows an example in which emission means for plural fiber bundles is disposed in a pipe 61. Laser oscillation means 10 including plural laser oscillation means, the emission means 100 for irradiating plural fiber bundles and laser irradiation means 30 are disposed in the pipe 61 positioned in a well 60, and power supplied by power supply means 70 is provided to the laser oscillation means 10 through an electric cable 71.

A laser beam generated by the laser oscillation means 10 is transmitted through laser transmission means 20 to the emission means 100 for irradiating the plural fiber bundles. The laser beam is emitted from a single fiber on the fiber bundles by the emission means 100 for irradiating the plural fiber bundles. The laser beam is transmitted to the laser irradiation means 30 through laser transmission means 22 composed of a bundle fiber formed by assembling plural fiber bundles. The laser beam is irradiated in liquid by the laser irradiation means 30 to generate laser-induced force. Also, a transparent laser beam having low absorptance of liquid may be generated.

Figure 22:
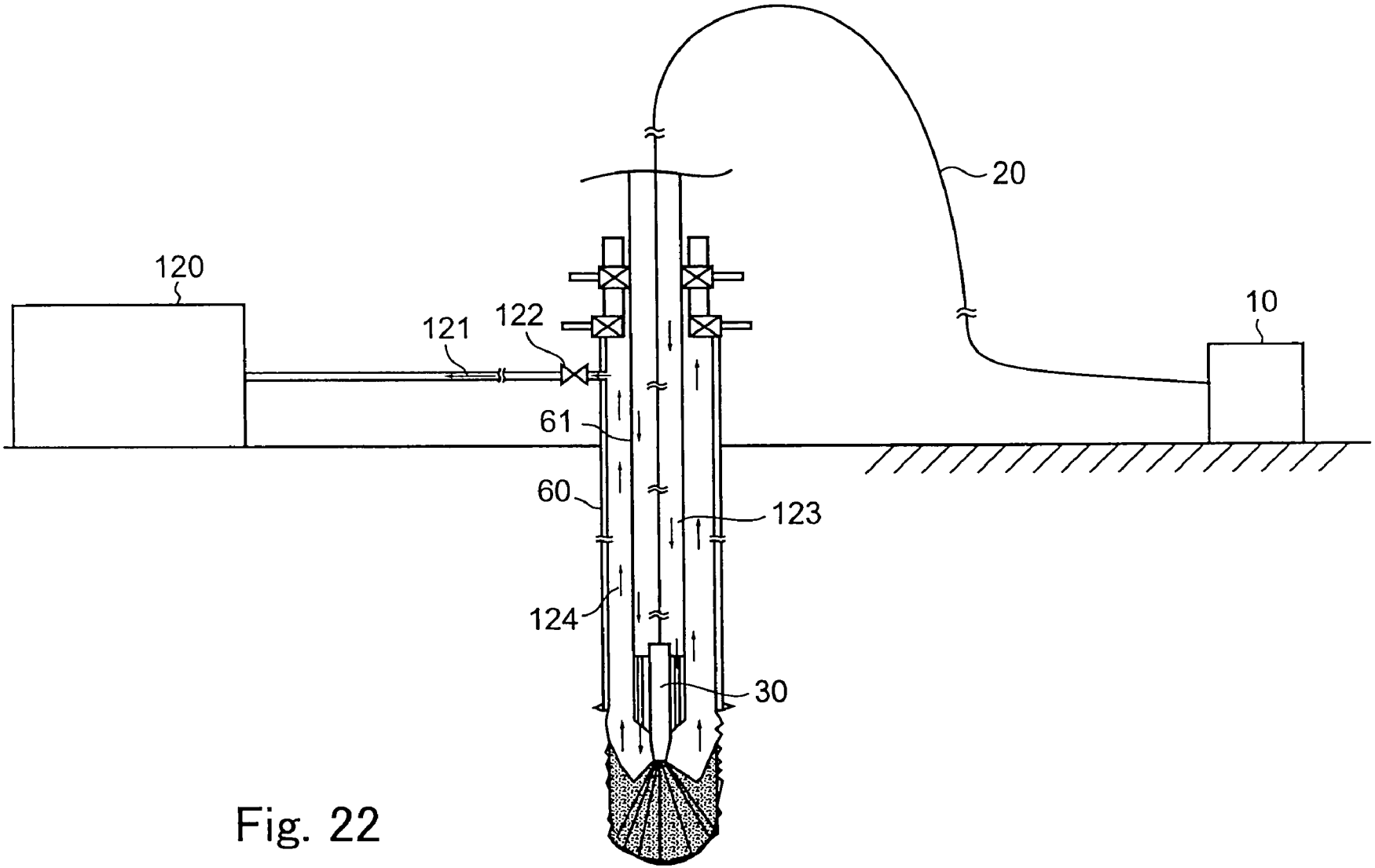
FIG. 22 is a schematic diagram illustrating a configuration of a device by way of example.

FIG. 22 shows a device in which laser oscillation means 10 is disposed on the ground and a configuration thereof.

A laser beam generated by the laser oscillation means 10 disposed on the ground is transmitted through laser transmission means 20 to laser irradiation means 30. The laser irradiation means 30 is disposed inside a pipe 61 positioned in a well 60. When a laser beam irradiated by the laser irradiation means 30 is a laser beam having a wavelength with high absorptance of liquid, a laser-induced force may be generated. Also, when a laser beam irradiated by the laser irradiation means 30 is a laser beam having a wavelength with low absorptance of liquid, the laser beam forms a transparent laser beam. The laser-induced force may allow excavation of a stratum to be carried out and the transparent laser beam can excavate a stratum, and cooperation between the laser-induced force and a thermal breakdown effect of the transparent laser beam, also, may allow excavation of a stratum to be carried out.

In addition, a fluid 123 injected on the ground is projected through a pipe 61 into a well 60 to form a fluid 124. A stratum (rock) broken down into pieces due to the laser-induced force or the thermal effect of the transparent laser beam is raised toward the ground in the well 60 by the fluid 124. A fluid 121 which reaches a valve 122 is delivered to a fluid circulation system 120.

Figure 23:
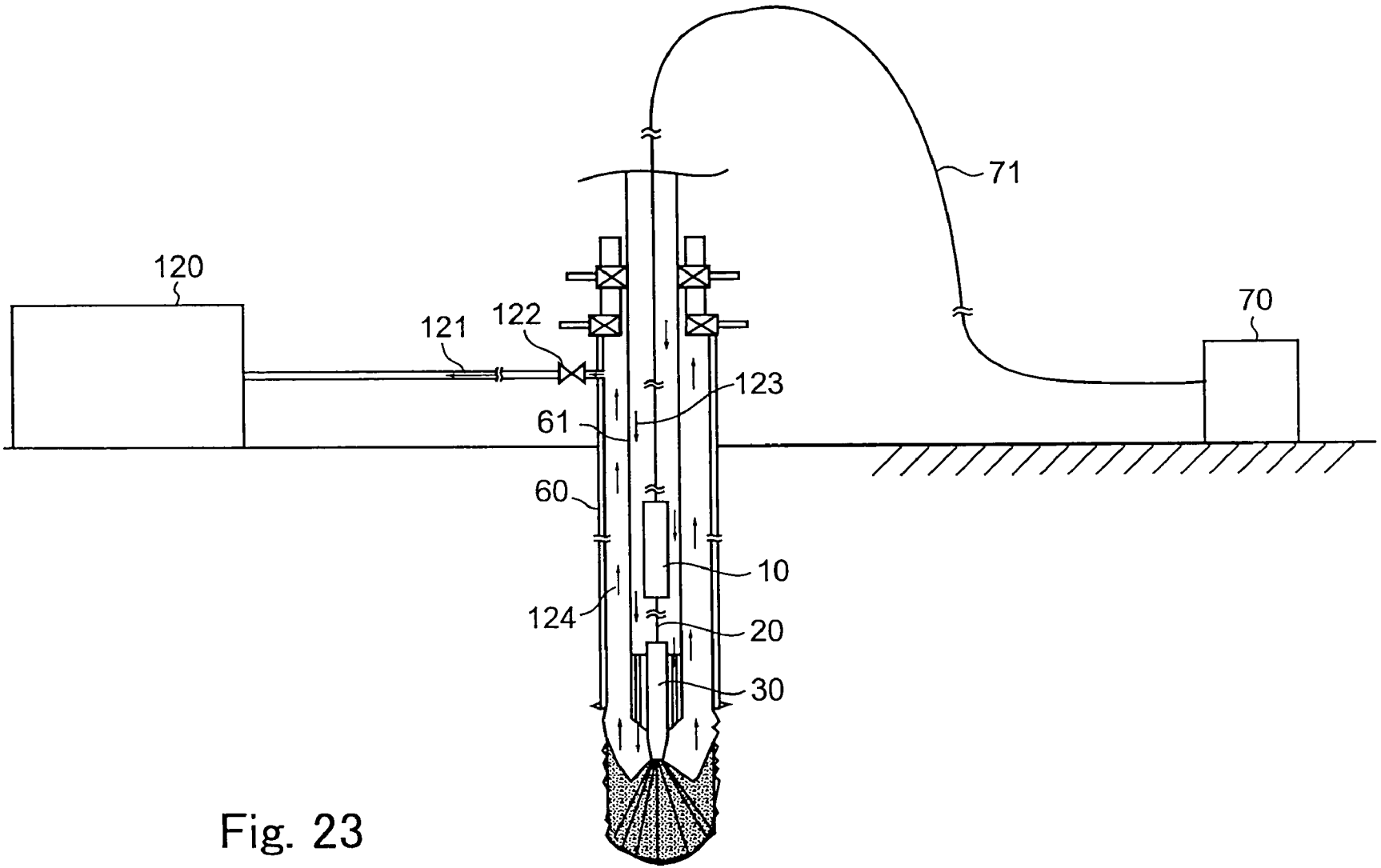
FIG. 23 is a schematic diagram illustrating a configuration of a device by way of example.

FIG. 23 shows an example in which laser oscillation means 10 is disposed in a pipe 61 positioned in a well 60. In this example, power supply means 70 is disposed on the ground. The laser oscillation means 10 and laser irradiation means 30 are disposed inside the pipe 61 positioned in the well 60, and the laser oscillation means 10 and the laser irradiation means 30 are connected by laser transmission means 20.

In the example shown in FIG. 23, electric power is supplied to the laser oscillation means 10 through an electric cable 71 by the power supply means 70. The laser oscillation means 10 is powered to generate a laser beam. The generated laser beam is transmitted through the laser transmission means 20 to reach the laser irradiation means 30.

When a laser beam irradiated by the laser irradiation means 30 has a wavelength with high absorptance of liquid, laser-induced force is generated. Also, when a laser beam irradiated by the laser irradiation means 30 has a wavelength with low absorptance of liquid, it forms a transparent laser beam. Effects according to these laser beams and a fluid circulation system 120 are similar to those explained in relation to the example in FIG. 22.

Figure 24:
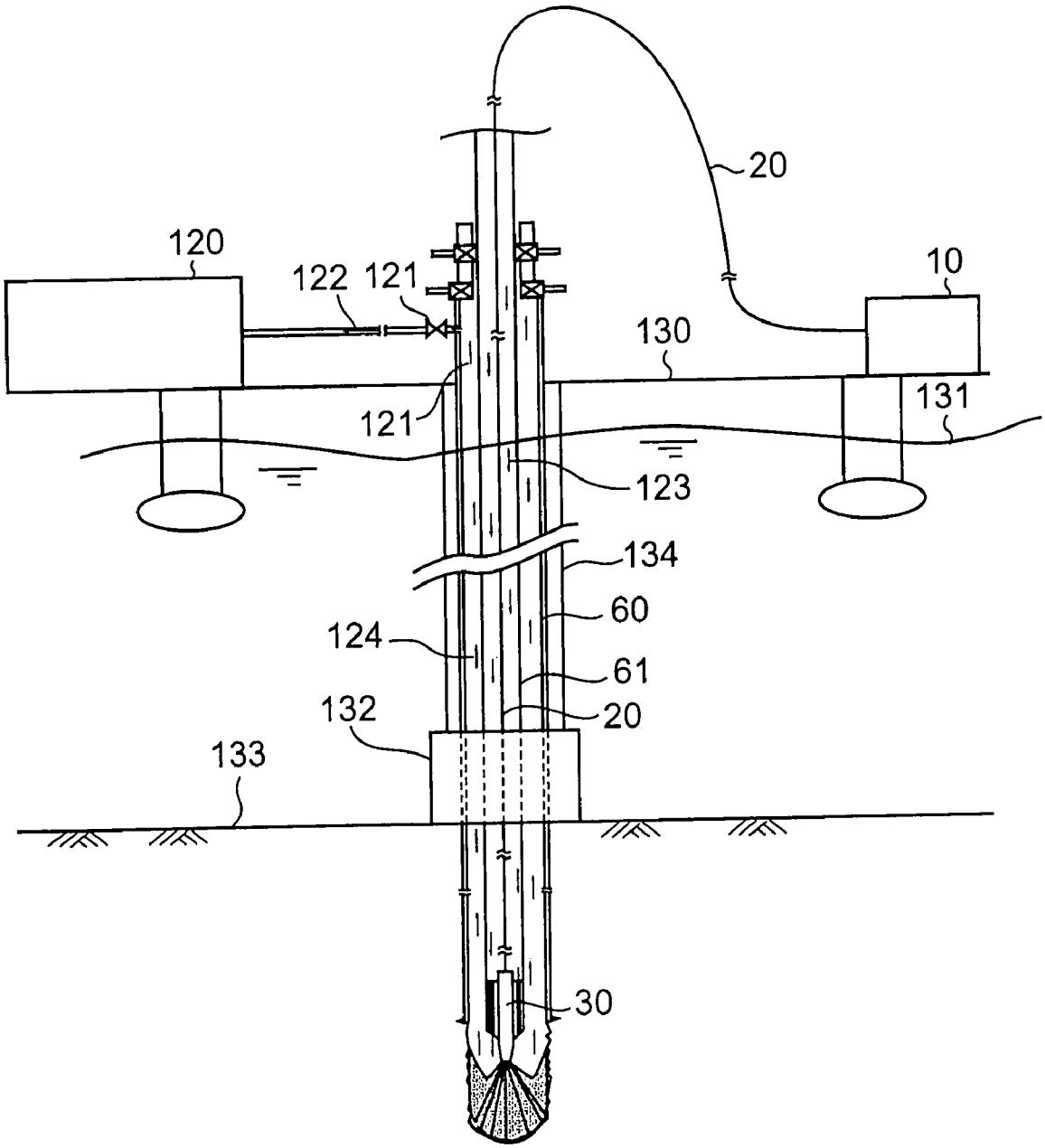
FIG. 24 is a schematic diagram illustrating a configuration of a device by way of example.

FIG. 24 shows an exemplary configuration of a device for excavation on the ocean. Laser oscillation means 10 is disposed on an ocean excavation facility 130. The ocean excavation facility 130 is situated above the water 131 and linked to an undersea mine mouth device 132 disposed on the bottom of sea 133 by a riser pipe 134. A well 60 disposed in the riser pipe 134 extends from the ocean excavation facility 130 through an undersea stratum to reach a stratum containing an underground resource. In the well 60, a pipe 61 is disposed.

A laser beam generated by the laser oscillation means 10 disposed on the ocean excavation facility 130 is transmitted through laser transmission means 20 to laser irradiation means 30 on the bottom of the well 60. When a laser beam irradiated by the laser irradiation means 30 has a wavelength with high absorptance of liquid, laser-induced force is generated. On the other hand, when a laser beam irradiated by the laser irradiation means 30 has a wavelength with low absorptance of liquid, it forms a transparent laser beam which may reach a stratum. The laser-induced force and/or a thermal effect which the transparent laser beam has may allow a stratum to be excavated.

In addition, a fluid 123 pressed into the pipe 61 on the ground is projected from inside the pipe 61 into the well 60, forming a fluid 124. The stratum (rock) broken down into pieces by the laser-induced force or an effect of the transparent laser beam is raised toward the ground inside the well 60 by the fluid 124. A fluid 121 which reaches a valve 122 is delivered to a fluid circulation system 120.

Figure 25:
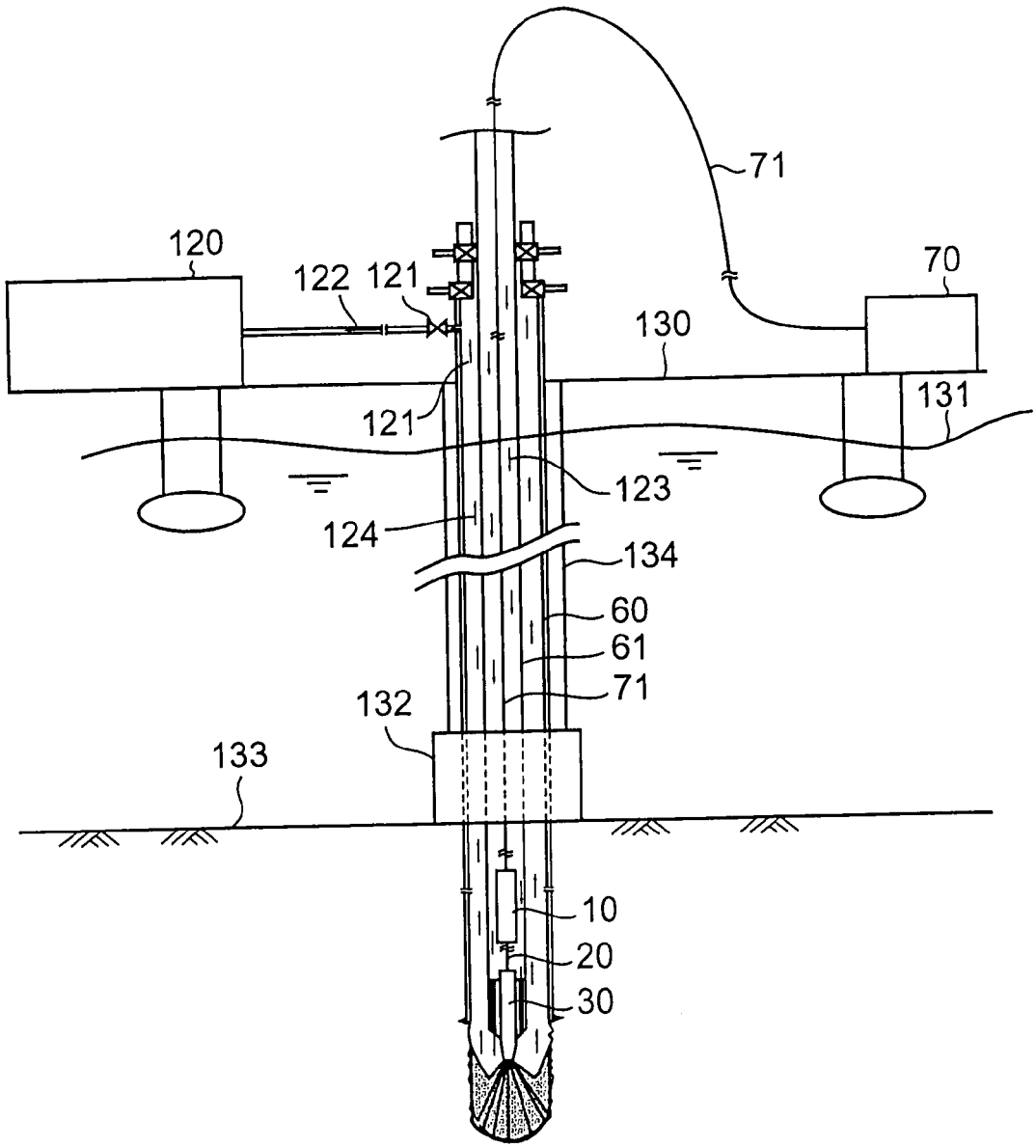
FIG. 25 is a schematic diagram illustrating a configuration of a device by way of example.

FIG. 25 shows, in case of ocean excavation, an example in which laser oscillation means is disposed in a pipe positioned in a shaft. A different point from the example shown in FIG. 24 is the fact that the laser oscillation means 10 is disposed in the well 60, and the power supply means 70 is disposed on the ocean excavation facility 130. Other part of the configuration and the effects are similar to those explained in relation to the example shown in FIG. 24. In this example, electric power is supplied through the electric cable 71 to the laser oscillation means 10 by the power supply means 70. The laser oscillation means 10 generates a laser beam, and the generated laser beam reaches the laser irradiation means 30 through the laser transmission means 20.

The invention claimed is:

1. A method for excavating a submerged stratum comprising the steps of:

inducing laser-induced force and laser irradiation in liquid using a first laser, thereby generating a bubble near an end of an output section of the first laser;

generating thermal effect on the submerged stratum using a second laser, a beam of the second laser passing through the bubble created by the first laser; and excavating the submerged stratum by using the laser-induced force and the thermal effect.

2. The method for excavating a submerged stratum according to claim 1, wherein the laser-induced force by the first laser is an effect based on at least one of a shock wave, a jet stream, a bubble flow and an acoustic wave.

3. The method for excavating a submerged stratum according to claim 1, wherein the first laser is one of a pulsed laser and a continuous-wave laser turned on and off intermittently.

4. The method for excavating a submerged stratum according to claim 1, wherein the second laser is one of a pulsed laser and a continuous-wave laser.

5. The method for excavating a submerged stratum according to claim 1, wherein the first laser is a solid laser.

6. The method for excavating a submerged stratum according to claim 1, wherein the second laser is a solid laser.

7. A device for excavating a submerged stratum including:

first laser oscillation means;

second laser oscillation means;

laser transmission means; and laser irradiation means, wherein the first laser oscillation means outputs at least one of a pulsed laser beam and a continuous-wave laser beam and adjusts at least one parameter selected from a group consisting of a laser pulse energy, a laser beam quality, a laser pulse width, a laser frequency and a laser wavelength, the second laser oscillation means outputs at least one of the pulsed laser beam and the continuous-wave laser beam and adjusts a laser frequency and a laser wavelength, and the first laser oscillation means induces laser-induced force and laser irradiation in liquid that generates a bubble near an end of an output section of the laser irradiation means, and the second laser oscillation means generates thermal effect on the submerged stratum by a beam passing through the bubble.

8. The device for excavating a submerged stratum according to claim 7, further comprising at least one of a laser wavelength conversion means and a laser pulse compression means.

9. The device for excavating a submerged stratum according to claim 7, wherein at least one of the first and second laser oscillation means is disposed in a pipe within an open hole.

10. The device for excavating a submerged stratum according to claim 9, wherein a laser bit composed of at least one of the first and second laser oscillation means and the laser irradiation means is disposed in a front end of the pipe within the open hole.

11. The device for excavating a submerged stratum according to claim 10, wherein the laser bit includes at least one of the laser wavelength conversion means and the laser pulse compression means.

12. The device for excavating a submerged stratum according to claim 7, wherein the laser transmission means comprises fibers composed of a single fiber and a plurality of fibers that sandwich laser incident means therebetween, a plurality of a single fiber, and one of a multicore fiber and a bundle fiber.

* * * * *